US010940076B2

(12) United States Patent
Haddock et al.

(10) Patent No.: US 10,940,076 B2
(45) Date of Patent: Mar. 9, 2021

(54) PERSONAL MASSAGER

(71) Applicant: Uccellini LLC, Bend, OR (US)

(72) Inventors: Lora LeeAnne Haddock, Bend, OR (US); Ada-Rhodes Short, Corvallis, OR (US); Douglas S. Layman, Bend, OR (US); Blake Michael Larkin, Eugene, OR (US); Brian Scott Gaza, Naperville, IL (US); Mark Hazelton, Philomath, OR (US); Kim Porter Henneman, Bend, OR (US)

(73) Assignee: Uccellini LLC, Bend, OR (US)

( * ) Notice: Subject to any disclaimer, the term of this patent is extended or adjusted under 35 U.S.C. 154(b) by 0 days.

(21) Appl. No.: 16/569,712

(22) Filed: Sep. 13, 2019

(65) Prior Publication Data

US 2020/0093682 A1 Mar. 26, 2020

Related U.S. Application Data

(63) Continuation-in-part of application No. 29/695,752, filed on Jun. 21, 2019, and a continuation-in-part of (Continued)

(51) Int. Cl.

| | |
|---|---|
| ***A61H 21/00*** | (2006.01) |
| ***A61H 15/00*** | (2006.01) |
| ***A61H 19/00*** | (2006.01) |

(52) U.S. Cl.

CPC ..... *A61H 15/0085* (2013.01); *A61H 19/40* (2013.01); *A61H 21/00* (2013.01); (Continued)

(58) Field of Classification Search

CPC ..... A61H 15/0085; A61H 19/40; A61H 2015/0064; A61H 2015/0071; (Continued)

(56) References Cited

U.S. PATENT DOCUMENTS

| | | | |
|---|---|---|---|
| 1,755,144 | A | 4/1930 | Arranz |
| 2,076,410 | A | 4/1937 | McGerry |

(Continued)

FOREIGN PATENT DOCUMENTS

| | | |
|---|---|---|
| CN | 105596194 | 5/2016 |
| CN | 206198255 | 5/2017 |

(Continued)

OTHER PUBLICATIONS

Young, Lee, International Application No. PCT/US19/50925, PCT Search Report & Written Opinion, dated Nov. 29, 2019, 13 pgs.

(Continued)

*Primary Examiner* — Christine H Matthews

(74) *Attorney, Agent, or Firm* — Maxine L. Barasch; Keohane & D'Alessandro, PLLC

(57) ABSTRACT

Disclosed embodiments provide an improved personal massager device. The massager device includes a stimulator, which is G-spot stimulator or a prostate stimulator. The stimulator includes an enclosure having an opening. A threaded post is disposed within the enclosure. The threaded post has a plurality of pitched threads. A roller is disposed within the plurality of pitched threads. The roller protrudes outside the opening of the enclosure. The threaded post is rotated back and forth by a motor, and as it does so, the roller traverses a path. A sheath is disposed tightly over the enclosure. The roller presses the sheath against the G-spot or prostate of the user, providing stimulation. In some embodiments, one or more of a start position of the roller and an end position of the roller are defined by user input.

27 Claims, 25 Drawing Sheets

Related U.S. Application Data application No. 29/675,567, filed on Jan. 3, 2019, and a continuation-in-part of application No. 29/675,567, filed on Jan. 3, 2019.

(60) Provisional application No. 62/869,008, filed on Jun. 30, 2019, provisional application No. 62/868,218, filed on Jun. 28, 2019, provisional application No. 62/868,232, filed on Jun. 28, 2019, provisional application No. 62/868,312, filed on Jun. 28, 2019, provisional application No. 62/868,247, filed on Jun. 28, 2019, provisional application No. 62/868,331, filed on Jun. 28, 2019, provisional application No. 62/868,279, filed on Jun. 28, 2019, provisional application No. 62/868,203, filed on Jun. 28, 2019, provisional application No. 62/868,266, filed on Jun. 28, 2019, provisional application No. 62/787,930, filed on Jan. 3, 2019, provisional application No. 62/731,840, filed on Sep. 15, 2018, provisional application No. 62/731,835, filed on Sep. 15, 2018, provisional application No. 62/731,836, filed on Sep. 15, 2018, provisional application No. 62/731,839, filed on Sep. 15, 2018, provisional application No. 62/731,838, filed on Sep. 15, 2018.

(52) U.S. Cl.
CPC ..... *A61H 2015/0064* (2013.01); *A61H 2015/0071* (2013.01); *A61H 2201/1635* (2013.01); *A61H 2201/1654* (2013.01); *A61H 2201/1666* (2013.01); *A61H 2201/1669* (2013.01); *A61H 2201/5007* (2013.01); *A61H 2201/5038* (2013.01); *A61H 2201/5097* (2013.01)

(58) Field of Classification Search
CPC ..... A61H 21/00; A61H 2201/1635; A61H 2201/1669; A61H 2201/5007; A61H 2201/5038; A61H 2201/5097
See application file for complete search history.

(56) References Cited

U.S. PATENT DOCUMENTS

| | | | |
|---|---|---|---|
| 8,308,631 | B2 | 11/2012 | Kobashikawa et al. |
| 9,339,434 | B1 | 5/2016 | Mayfield |
| 10,004,659 | B1 | 6/2018 | Campbell |
| 2003/0176817 | A1 | 9/2003 | Chang |
| 2004/0082831 | A1 | 4/2004 | Kobashikawa et al. |
| 2005/0240122 | A1 | 10/2005 | Gander et al. |
| 2007/0142754 | A1 | 6/2007 | Nan |
| 2009/0069730 | A1 | 3/2009 | Knyrim |
| 2010/0268021 | A1 | 10/2010 | Standfest et al. |
| 2013/0178769 | A1 | 7/2013 | Schmidt |
| 2014/0309565 | A1 | 10/2014 | Allen |
| 2015/0196455 | A1 | 7/2015 | Mertens et al. |
| 2016/0045392 | A1 | 2/2016 | Massey et al. |
| 2017/0100303 | A1 | 4/2017 | Kotlov |
| 2017/0281457 | A1 | 10/2017 | Witt |
| 2018/0140502 | A1 | 5/2018 | Shahoian et al. |

FOREIGN PATENT DOCUMENTS

| | | | |
|---|---|---|---|
| EP | 3300712 | A1 | 4/2018 |
| JP | 10165465 | | 6/1998 |
| JP | 2007082990 | A | 9/2005 |
| WO | 9802124 | | 1/1998 |
| WO | 2013067367 | A1 | 5/2013 |
| WO | 2017205860 | A1 | 11/2017 |

OTHER PUBLICATIONS

Eaton, Kit, "New Sasi Sex Toy Gets Intelligent With Your Nether Regions", GIZMODO, https://gizmodo.com/new-sasi-sex-toy-gets-intelligent-with-your-nether-regi-346406, Jan. 18, 2008, 4 pgs.
Sloan, Kate, "Review: JeJoue Sasi", GIRLYJUICE, https://girlyjuice.net/review-jejoue-sasi/, Mar. 11, 2013, 2 pgs.
Sutra, Cara, Je Joue Sasi Review (& LELO ORA Oral Sex Simulator Comparison), CARASUTRA, https://.carasutra.com/review/je-joue-sasi-review-lelo-ora-oral-sex-simulator-comparison/, Feb. 24, 2014, 6 pgs.
Alptraum, Lux, "The Vibrator of the Future Won't Vibrate", MOTHERBOARD Tech by VICE, https://www.vice.com/en_us/article/qkjz8x/the-vibrator-of-the-future-wont-vibrate, Jul. 14, 2016, 6 pgs.
"Je Joue SaSi Vibrator, Plum", Amazon, https://camelcamelcamel.com/Je-Joue-SaSi-Vibrator-Plum/product/B002T5LKMQ, 2010, 5 pgs.
"Je Joue Sasi, Tongue Massager", AliExpress, https://www.aliexpress.com/item/552706705.html, 2008, 5 pgs.
"SASI Product", 2008, 5 pgs.
EP Application No. 19817568.9, Partial Search Report, dated Jul. 17, 2020, 37 pgs.
EP Application No. 198175697-1126, Supplementary Partial EP Search Report, dated Sep. 22, 2020, 16 pgs.
EP Application No. 19817570.5-1126, Search Report, dated Sep. 23, 2020, 15 pgs.

PERSONAL MASSAGER

FIELD

The present invention relates generally to personal massagers, and more particularly, to personal massagers for G-spot or prostate message.

BACKGROUND

There are various devices available for use by female bodies for sexual stimulation. They are typically configured stimulate the clitoris and/or the Grafenberg Spot. Such area, also known as the "G-spot," is a nerve reflex area inside the vagina along the anterior surface. In male bodies, the prostate is a gland surrounding the neck of the bladder. Products for G-spot or prostate massage are entirely manually operated, or are provided with internal motors that achieve stimulation by shape, texture and vibration. There exists a need for improvements in devices for stimulation of the G-spot and the prostate.

SUMMARY

Disclosed embodiments provide an improved personal massager device. The massager device includes a stimulator, which is G-spot stimulator or a prostate stimulator. The stimulator includes an enclosure having an opening. A threaded post is disposed within the enclosure. The threaded post has a plurality of pitched threads. A roller is disposed within the plurality of pitched threads. The roller protrudes outside the opening of the enclosure. The threaded post is rotated back and forth by a motor, and as it does so, the roller traverses a path. A sheath is disposed tightly over the enclosure. The roller presses the sheath against the G-spot or prostate of the user, providing stimulation. In some embodiments, one or more of a start position of the roller and an end position of the roller are defined by user input.

In one embodiment, there is provided a massager device, comprising: an enclosure comprising an opening, wherein the enclosure is an elongate shape; a threaded post disposed within the enclosure, the threaded post comprising a plurality of pitched threads; a roller disposed within the plurality of pitched threads, wherein the roller protrudes outside the opening of the enclosure; a driver configured to rotate the threaded post; and an elastic sheath disposed at least over the opening.

In another embodiment, there is provided a massager device, comprising: an enclosure comprising an opening, wherein the enclosure is an elongate shape; a threaded post disposed within the enclosure, the threaded post comprising a plurality of pitched threads; a roller disposed within the plurality of pitched threads, where the roller protrudes through the opening; a motor, the motor mechanically coupled to the threaded post; an elastic sheath disposed at least over the opening and covering the roller; a processor; and a memory coupled to the processor, wherein the memory contains instructions, that when executed by the processor, alternate motion direction of the motor such that the roller oscillates on a path between the start range position and an end range position.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1A:
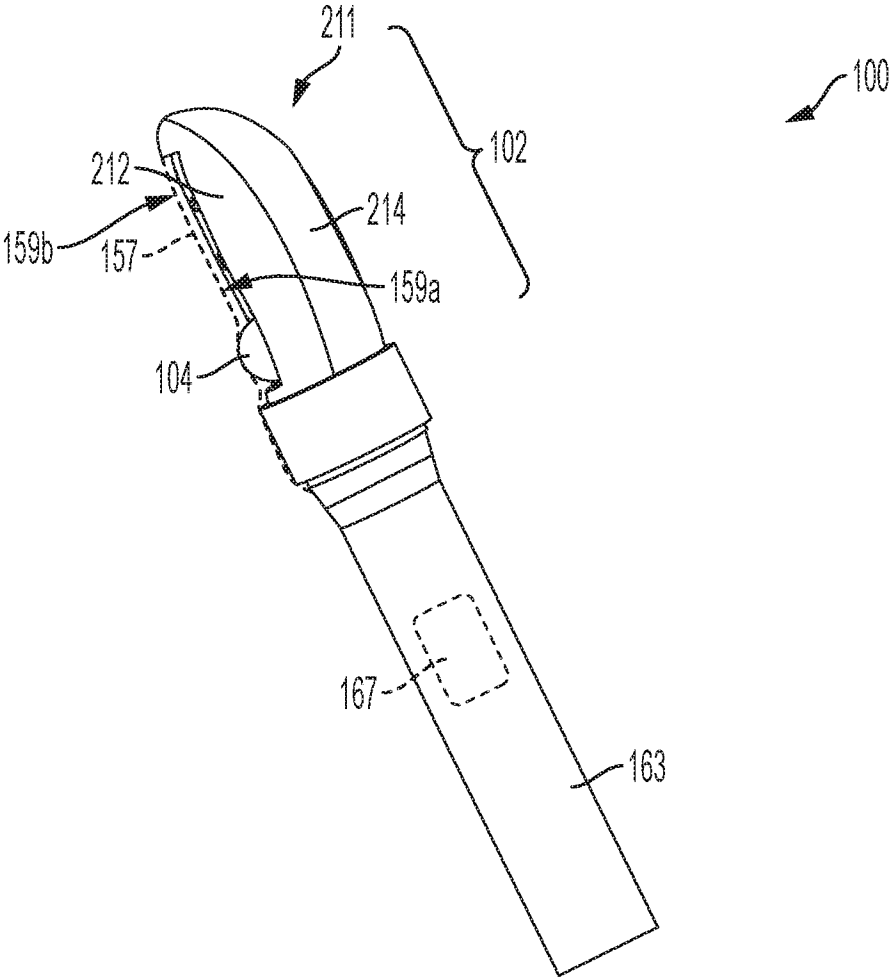
FIG. 1A shows a side view of an example massager device in accordance with embodiments of the present invention, without a sheath thereon for clarity.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Disclosed embodiments provide an improved personal massager device. The massager device includes a stimulator, which is G-spot stimulator or a prostate stimulator. The stimulator includes an enclosure having an opening. A threaded post is disposed within the enclosure. The threaded post has a plurality of pitched threads. A roller is disposed within the plurality of pitched threads. The roller protrudes outside the opening of the enclosure. The threaded post is rotated back and forth by a motor, and as it does so, the roller traverses a path. A sheath is disposed tightly over the enclosure. The roller presses the sheath against the G-spot or prostate of the user, providing stimulation. In some embodiments, one or more of a start position of the roller and an end position of the roller are defined by user input.

Reference throughout this specification to "one embodiment," "an embodiment," "some embodiments", "embodiments," or similar language means that a particular feature, structure, or characteristic described in connection with the embodiment is included in at least one embodiment of the present invention. Thus, appearances of the phrases "in one embodiment," "in an embodiment," "in some embodiments", "in embodiments," and similar language throughout this specification may, but do not necessarily, all refer to the same embodiment.

The terminology used herein is for the purpose of describing particular embodiments only and is not intended to be limiting of this disclosure. As used herein, the singular forms "a", "an", and "the" are intended to include the plural forms as well, unless the context clearly indicates otherwise.

Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, integers, steps, operations, elements, components, and/or groups thereof.

For the purposes of disclosure, the word, "substantially" is defined as "for the most part". It means "to a great extent," but having some room for some minor variation.

Items shown covered by another are shown in dashed or dotted lines. So, dotted or dashed lines means an item is situated below another item shown in complete lines.

Moreover, the described features, structures, or characteristics of the invention may be combined in any suitable manner in one or more embodiments. Features, structures, or characteristics of one embodiment can be mixed and matched with features, structures, or characteristics of another embodiment. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

Figure 1B:
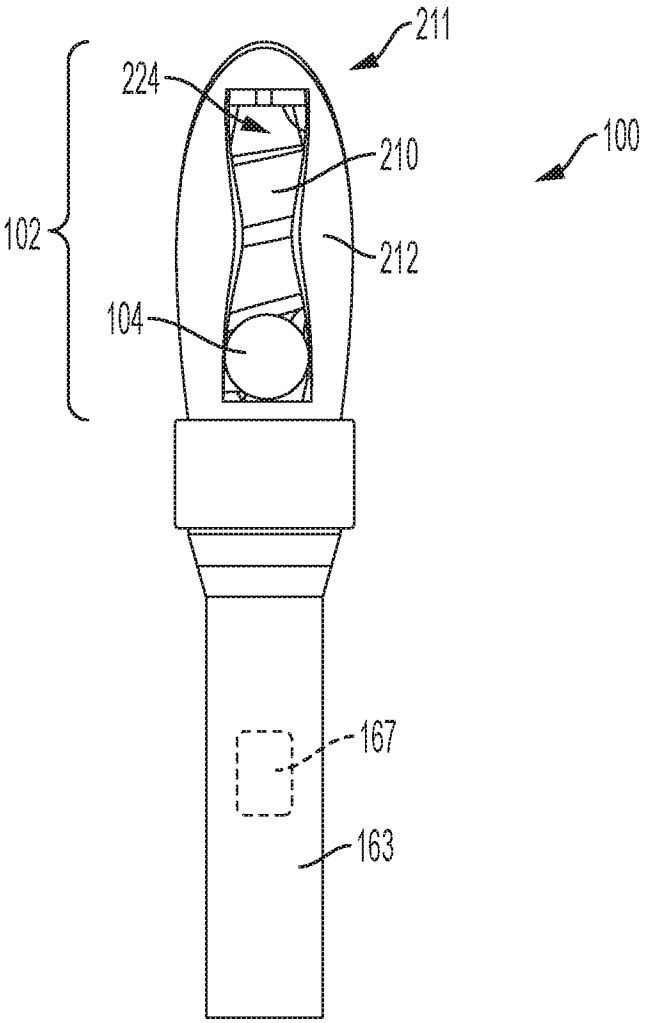
FIG. 1B shows a front view of a massager device in accordance with embodiments of the invention, without a heath thereon for clarity.

FIG. 1A shows a side view of an example massager device 100 in accordance with embodiments of the present invention (without user interface for clarity). FIG. 1B shows a front view of a massager device 100 in accordance with embodiments of the invention (still without user interface, for clarity). An external sheath (except for representation of a portion 157 thereof on FIG. 1A) is removed for clarity from FIGS. 1A and 1B. Embodiments include an insertable shaft 102. The shaft 102 includes a roller 104 disposed adjacent a sheath (a portion thereof is represented at 157). The sheath is tightly bound to the shaft 102 (and in some implementations, handle 163). Shaft 102 may be the same structure as, or include, enclosure 211. The roller 104 protrudes from the enclosure 211 through an opening 224 in the enclosure 211. The roller 104 is disposed to traverse a path on a threaded post 210 under sheath 157, during usage. In embodiments, the roller is adjacent an interior side 159*a* of the sheath 157 and the massage surface is the exterior side 159*b* of the sheath along the path of the roller. The roller 104 may roll over the interior side 159*a* to reduce friction from otherwise rubbing. The enclosure, threaded post, and roller are sized such that, during operation, the roller remains within the opening of the enclosure, and does not travel around the threaded post in between the interior walls of the enclosure. Shaft 102, with the sheath disposed thereon, is insertable into a vagina or anus.

In the example shown, the enclosure 211 has an enclosure first portion 214 and an enclosure second portion 212. Although depicted as two portions, in some embodiments, the enclosure may comprise only a single one-piece contiguous portion or more than two portions. In embodiments, the enclosure is substantially rigid, made from plastic, metal, glass, or other suitable material.

In some embodiments, the enclosure 211 is made from plastic, silicone, hard rubber, composite, metal or other suitable material. In some embodiments, the roller 104 is made from plastic, silicone, hard rubber, composite, metal or other suitable material. In some embodiments, the threaded post 210 is made from plastic, silicone, hard rubber, composite, metal or other suitable material.

A massage surface represented at 159*b*, of a sheath, a portion of which is represented at 157, is disposed over the opening 224 such that roller 104 can impart stimulation from the massager device 100 to a user's body. In some embodiments, the sheath 157 may additionally extend over portions of the massage device other than only the opening. In embodiments, the sheath 157 is comprised of silicone, rubber, plastic, or other suitable flexible elastic material such that the roller 104 can protrude and extend the material outward as it moves along its path. As the position of the roller 104 changes, the material returns to its original position.

In some embodiments, the massager device 100 may further comprise a handle 163. The handle is made of plastic, wood, glass, or other suitable material. One or more components for implementation of the massager device 100 may be included within the handle 163, such as a battery. These components are shown generally as 167.

Figure 1D:
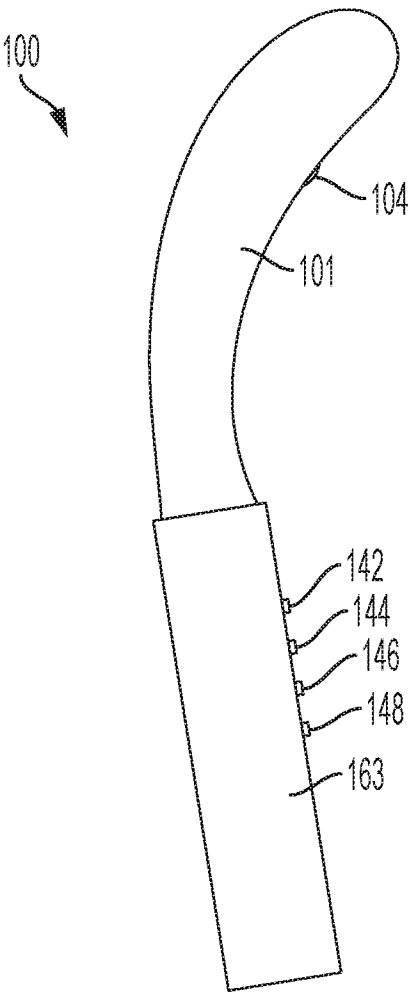
FIG. 1D shows a rear perspective view of massager device of FIGS. 1A and 1B showing a sheath thereon.
Figure 1C:
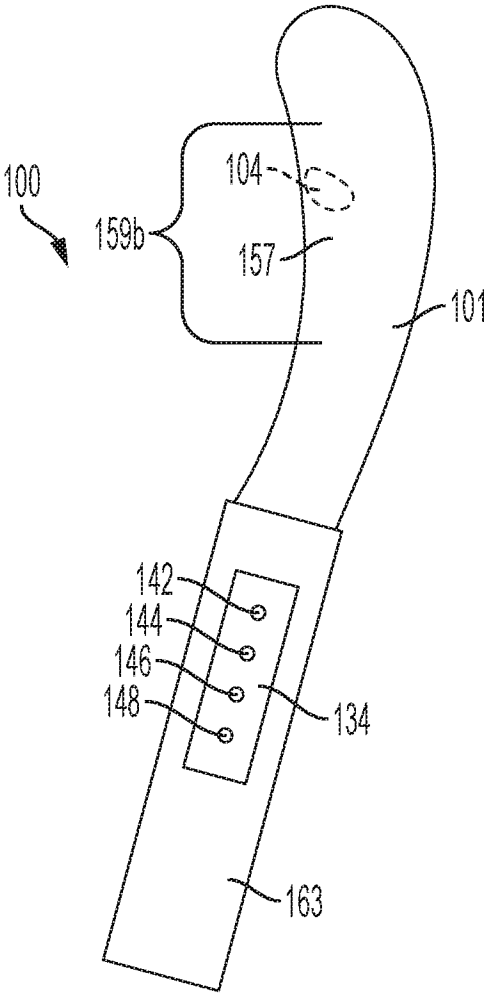
FIG. 1C shows a front perspective view of massager device of FIGS. 1A and 1B showing a sheath thereon.

FIG. 1C shows a front perspective view of massager device similar to that of FIG. 1A, having a sheath 101 extended thereon covering the enclosure and roller (reference number 157 was a representation of a portion of sheath 101 thereof). FIG. 1D shows a back perspective view of massager device of FIG. 1A having the sheath 101 thereon. The sheath 101 gives the device a substantially smooth exterior with the roller 104 able to protrude from underneath during use. In some embodiments, the sheath 101 may include bumps, ridges, or other massage points. The sheath 101 is substantially flexible and elastic. Roller 104 is in view protruding from beneath the massage surface 159*b* (FIG. 1A). The sheath 101 is tightly stretched at least over the opening of the enclosure and secured via mechanical means, adhesive or in some other suitable manner. In some embodiments, the sheath 101 can be stretched over the enclosure, opening, and handle.

As shown on FIG. 1C, in some embodiments, there is provided an onboard user interface 134. User interface 134 may be on handle 163. The user may perform the functions of controlling the speed and/or range of motion of the roller 104 via a user interface 134. In some embodiments, user interface 134 comprises user buttons 144, 146, and 148. In embodiments, user button 144 performs a speed increase, user button 146 performs a speed decrease, and user button 148 is used to establish user-defined ranges of motion. Other user interfaces are possible in embodiments of the present invention. In some embodiments, a dedicated power button 142 turns the massager device on and off in a toggle mode of operation. It should be recognized that this is an example user interface, and other configurations with more, fewer, or different controls are included within the scope of the invention.

In some embodiments, the massager device 100 is a sex toy or a medical device. In some embodiments, the massager device 100 is a G-spot massager. In some embodiments, the massager device 100 is a prostate massager. In some embodiments, the roller is a prostate stimulator. In some embodiments, the roller is a G-spot stimulator.

Figure 2C:
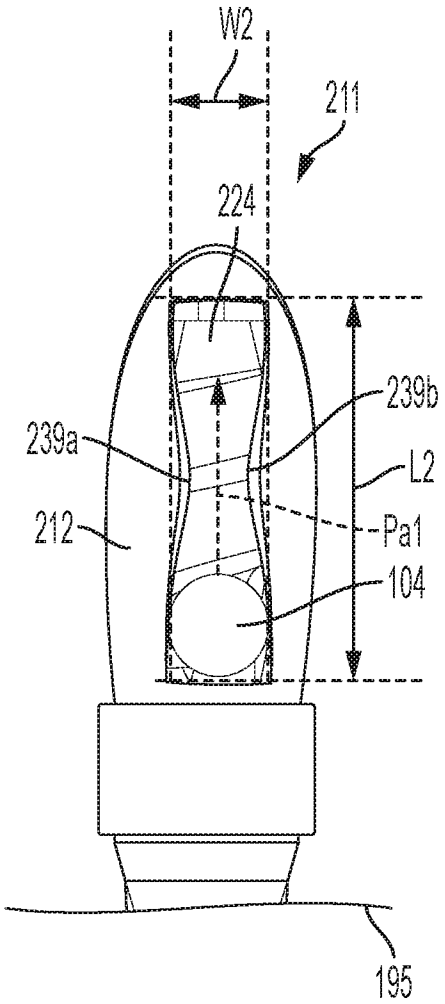
FIG. 2C is a front view of a portion of a massager device in accordance with embodiments of the present invention showing detail of the enclosure portion without a sheath thereon.
Figure 2B:
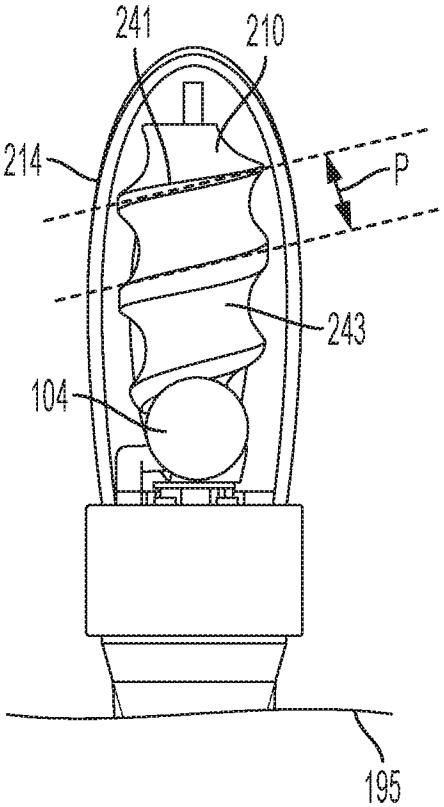
FIG. 2B is a front view showing detail of a portion of a massager device in accordance with embodiments of the present invention.
Figure 2A:
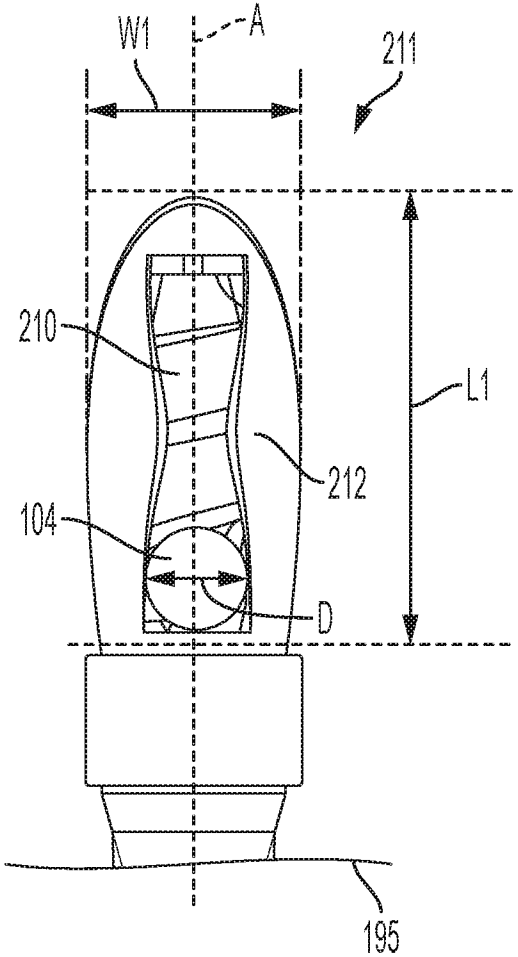
FIG. 2A is a front view showing detail of a portion of an embodiment of a massager device in accordance with embodiments of the present invention.

FIG. 2A is a front view showing detail of a portion of an embodiment of a massager device (also a "stimulator" herein) in accordance with embodiments of the present invention. Line 195 in the figures represents a break line. In FIG. 2A, an external sheath is removed for clarity. In some embodiments, the roller 104 is spherical. The roller 104 has a width D. In some embodiments, D ranges from 8 millimeters to 30 millimeters. In some embodiments, D ranges from 19 millimeters to 24 millimeters. The roller 104 may be comprised of metal, plastic, composite, hard rubber, or other suitable material. The roller 104 is held within the threads of the threaded post 210 by pressure of a sheath. The enclosure 211 is an elongate shape having a length L1, and a width W1, where L1 is greater than W1. In some embodiments, L has a value in the range from 5 centimeters to 17 centimeters, and W has a value in the range from 3 centimeters to 7 centimeters. In some embodiments, roller 104 is disposed to traverse a path, along or in alignment with, longitudinal axis A of the elongate shape of the enclosure. In some embodiments, roller 104 is disposed to traverse a path, substantially along or in substantially in alignment with, the elongate shape of the enclosure 211. This creates a "come hither" like motion with the roller 104 moving back and forth along a length of the enclosure 211, imitating natural movement of a finger.

FIG. 2B is a front view showing detail of a portion of a massager device in accordance with embodiments of the present invention with the enclosure portion 212 removed to illustrate additional parts. In this view, the threaded post 210 is shown. The threaded post has threads, an example of which is pointed out at 241. The threads are a protrusion that extend around the elongate core 243 of the threaded post 210 like a screw. The threads have a pitch P. The pitch P corresponds to the width D of the roller 104. The roller 104 is disposed within the plurality threads. During operation, as a motor rotates the threaded post 210 in an alternating clockwise and counterclockwise motion (or alternating counterclockwise and clockwise motion), the spherical roller 104 moves along the threads 241 of the threaded post 210 to perform a massage stimulation function.

FIG. 2C is a front view of a portion of a massager device in accordance with embodiments of the present invention showing detail of the enclosure portion 212 without a sheath thereon. The enclosure portion 212 has an opening 224 which allows the roller 104 to protrude outside of the enclosure 211. In embodiments, the elastic sheath presses the roller 104 firmly against the threaded post 210, keeping the roller 104 disposed within the threads 241. The opening 224 of the enclosure 211 serves as a guide for the roller 104. The opening 224 has rails, indicated as 293*a* and 293*b*, disposed along two sides of a longitudinal axis of the threaded post with the roller 104 disposed therein between.

As the threaded post 210 rotates, the roller 104 travels along path Pa1, which is defined by the rails of opening 224. In embodiments, the roller travels along a linear path. In some embodiments, the opening 224 is of a size such that its maximum width W2 is less than the width D of the roller 104 such that the roller 104 may protrude without being able to completely pass through opening 224.

Figure 2E:
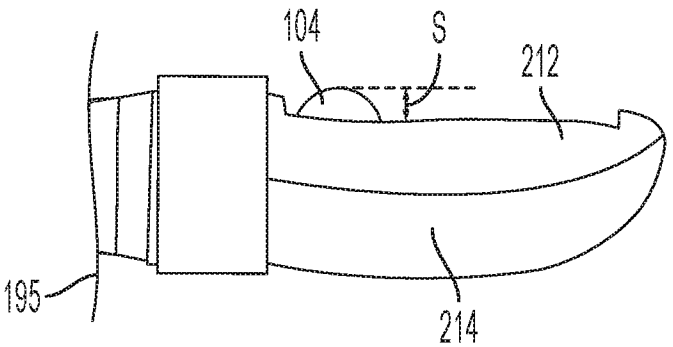
FIG. 2E is a side view showing detail of a portion of a massager device in accordance with embodiments of the present invention without sheath.
Figure 2D:
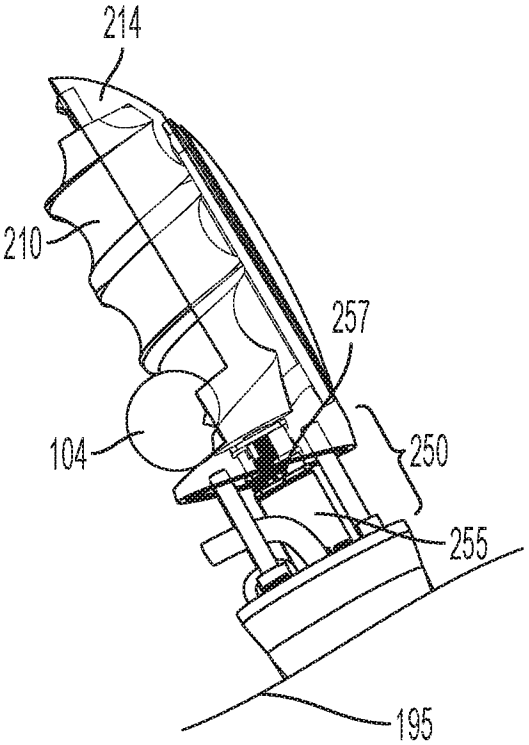
FIG. 2D is a view showing additional details of a portion of a massager device in accordance with embodiments of the present invention.

FIG. 2D is a view showing additional details of a portion of a massager device in accordance with embodiments of the present invention. In this view, the enclosure portions are removed to show details of an example driver 250. The driver 250 has a motor 255 and an encoder 257. The driver 250 includes the motor, as well as additional mechanical coupling such as shafts, gears, and/or other components for coupling the threaded post 210 to the motor. The motor 255 is an electric motor that operates in a reciprocating manner to alternate between clockwise and counterclockwise rotation (or vis versa). The encoder 257, or other suitable mechanism, may be used for tracking the position of the threaded post 210 relative to an initial "home" position. In some embodiments, the encoder 257 may be integrated into the motor 255. The motor 255 is mechanically coupled to the threaded post 210.

FIG. 2E is a side view showing detail of a portion of a massager device in accordance with embodiments of the present invention without sheath. In this view, it can be seen that the roller 104 protrudes outside of the enclosure by a protrusion length S. In some embodiments, the protrusion length S has a value ranging from 8 millimeters to 16 millimeters. In some embodiments, the value may be outside of such example range within the scope of the present invention.

Figure 2F:
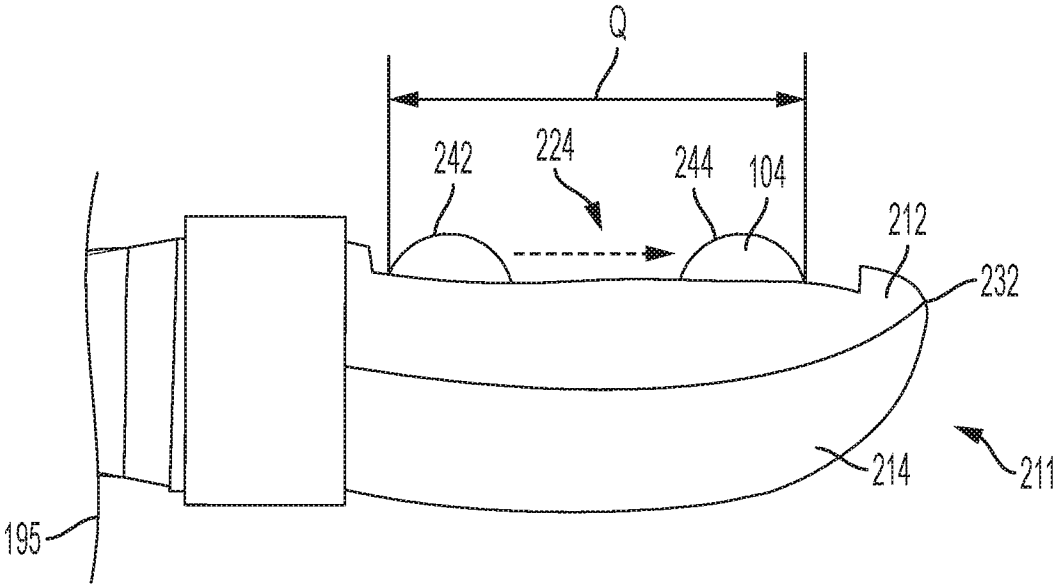
FIG. 2F is a side view showing detail of a portion of a massager device with start range and end range positions indicated in accordance with some embodiments of the present invention.

FIG. 2F is a side view showing detail of a portion of a massager device with start range and end range positions indicated in accordance with some embodiments of the present invention. The roller 104 traverses along path Q. In some embodiments, a first position 242 is a starting range position, and a second position 244 is the end range position. In some embodiments, the first position 242 is an end range position, and the second position 244 is the start range position. By controlling the amount of rotation of the threaded post 210, the roller 104 can be made to alternate between the first position 242 and the second position 244, or any intermediate locations between those two positions. In some embodiments, the start range position is user-defined by user input with the end-range position being a default predetermined setting (e.g., calibrated by the factory). In some embodiments, the end range position is user-defined by user input with the start range position being a default predetermined setting. In some embodiments, both the start range position and the end-range position are user-defined by user input. In some embodiments, both the start range position and the end-range position are default predetermined settings.

Referring now again also to FIG. 2C, the opening 224 of the enclosure 211 serves as a guide for the roller 104. The opening 224 has rails, indicated as 293*a* and 293*b*, disposed along two sides of a longitudinal axis of the threaded post with the roller 104 disposed therein between. As the threaded post 210 rotates, the roller 104 travels along a path, which is defined by the rails 293*a* and 293*b* of opening 224. In some embodiments, the roller travels along a linear path.

Figure 3:
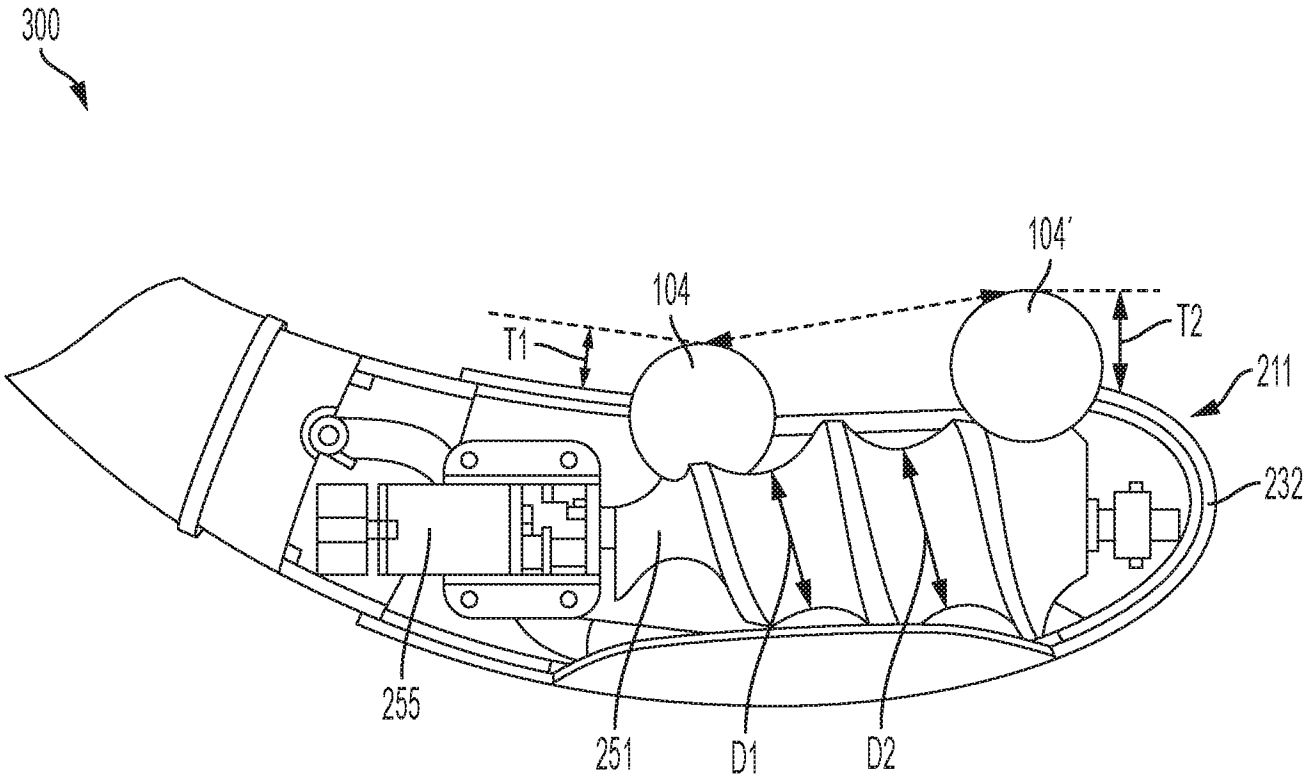
FIG. 3 shows an embodiment of a portion of a massager device having a tapered threaded post.

FIG. 3 shows an embodiment of a portion of a massager device having a tapered threaded post, with external sheath removed for clarity. In the embodiment of FIG. 3, massager device 300 is shown with a tapered threaded post 251. The tapered threaded post 251 has an increasing diameter in the direction towards the enclosure tip 232. In FIG. 3, two diameters are indicated, D1 and D2, where D2 is greater than D1. In embodiments, the diameter of the tapered threaded post 251 may gradually increase over the length of the tapered threaded post. In some embodiments, the tapered threaded post 251 has a minimum diameter ranging from 1 centimeter to 1.5 centimeters, and a maximum diameter of 2 centimeters to 3 centimeters. These values are examples, and any suitable values may be included within the scope of the invention.

During operation, the motor 255 alternates directions periodically to rotate the threaded post 251 in a clockwise direction for a predetermined duration, followed by a counterclockwise direction for a predetermined duration (or vis versa). This causes the spherical roller 104 to move back and forth between the locations indicated by 104 and 104'. As the spherical roller 104 moves back and forth, the protrusion length changes. The protrusion length is the length that the spherical roller 104 extends beyond the enclosure. At the position indicated by 104, the spherical roller has a protrusion length T1. At the position indicated by 104', the spherical roller has a protrusion length T2. In this embodiment, T2 is greater than T1. This is due to the tapered threaded post 251 being disposed to lower the roller at the position indicated by 104, as compared to the position indicated by 104'. In embodiments, the position indicated at 104 is a home position for the roller. A home position is an initialization position that may be used as part of a power-on sequence. During a power-on sequence, the device may first be brought to its home position. In some embodiments, during a power-off sequence, the device may be returned to its home position. When the device is powered off, the motor 255 operates to return the roller to the position indicated as 104. This can serve to minimize stretching of an elastic sheath that is disposed over the stimulator when the device is not in use, thereby prolonging the life of the device. In embodiments, a processor executes instructions in memory to perform a homing operation prior to shutdown of the device. The homing operation returns the roller to the position indicated as 104 based on encoder input, limit switches, or other suitable position indicating mechanisms and/or techniques.

In some embodiments, the tapered threaded post 251 may be installed in a reverse orientation, such that diameter D1 is greater than diameter D2, and thus, protrusion length T1 is greater than protrusion length T2. The increased protrusion length causes the spherical roller 104 to press harder against the G-spot or prostate area during use. Thus, in the embodiment shown, the applied force of the spherical roller 104 increases as the spherical roller 104 advances towards the enclosure tip 232. In other embodiments, where the threaded post 251 is installed in the reverse orientation, the applied force of the spherical roller 104 decreases as the spherical roller 104 advances towards the enclosure tip 232.

Figure 4B:
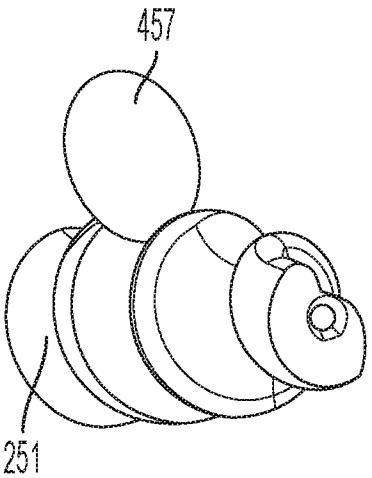
FIG. 4B shows another view of the tapered threaded post of FIG. 4A for a stimulator having an ovular roller.
Figure 4A:
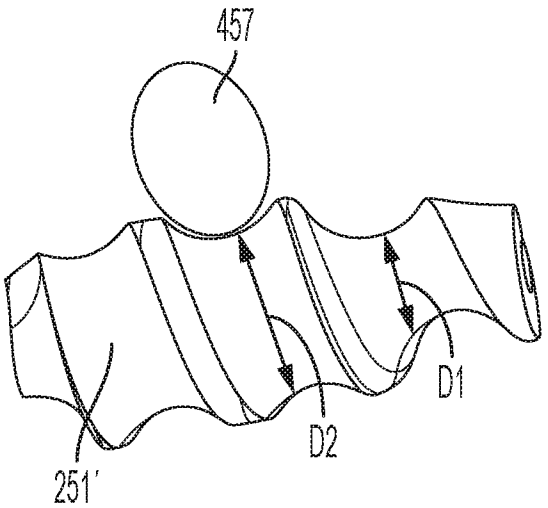
FIG. 4A is an embodiment of tapered threaded post for a stimulator having an ovular roller.

FIGS. 4A and 4B show an embodiment of tapered threaded post 251 for a stimulator having an ovular roller 457. FIG. 4A shows a side view of a tapered threaded post 251' having diameter D1 and diameter D2, where D2 is greater than D1. In this embodiment, an ovular roller 457 is used in place of the spherical roller of FIG. 3. FIG. 4B is a perspective view of the tapered threaded post of FIG. 4A. The ovular roller 457 can serve to create an increased protrusion length, thereby providing additional pressure on the G-spot or prostate region of the user as compared with the spherical roller 104.

Figure 5:
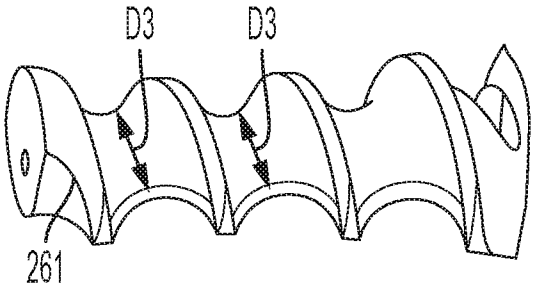
FIG. 5 shows an example of a constant diameter threaded post in accordance with some embodiments of the present invention.

FIG. 5 shows an example of a constant diameter threaded post 261 in accordance with some embodiments of the present invention. In this view, the threaded post has a diameter D3 between the threads. D3 is constant in this example.

Figure 6:
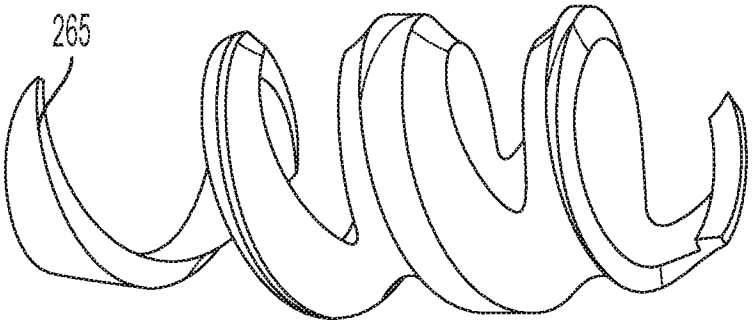
FIG. 6 shows an example of a hollow threaded post in accordance with some embodiments of the present invention.

FIG. 6 shows an example of a hollow threaded post 265 in accordance with some embodiments of the present invention. In this embodiment, the core of the threaded post is hollow.

Figure 7:
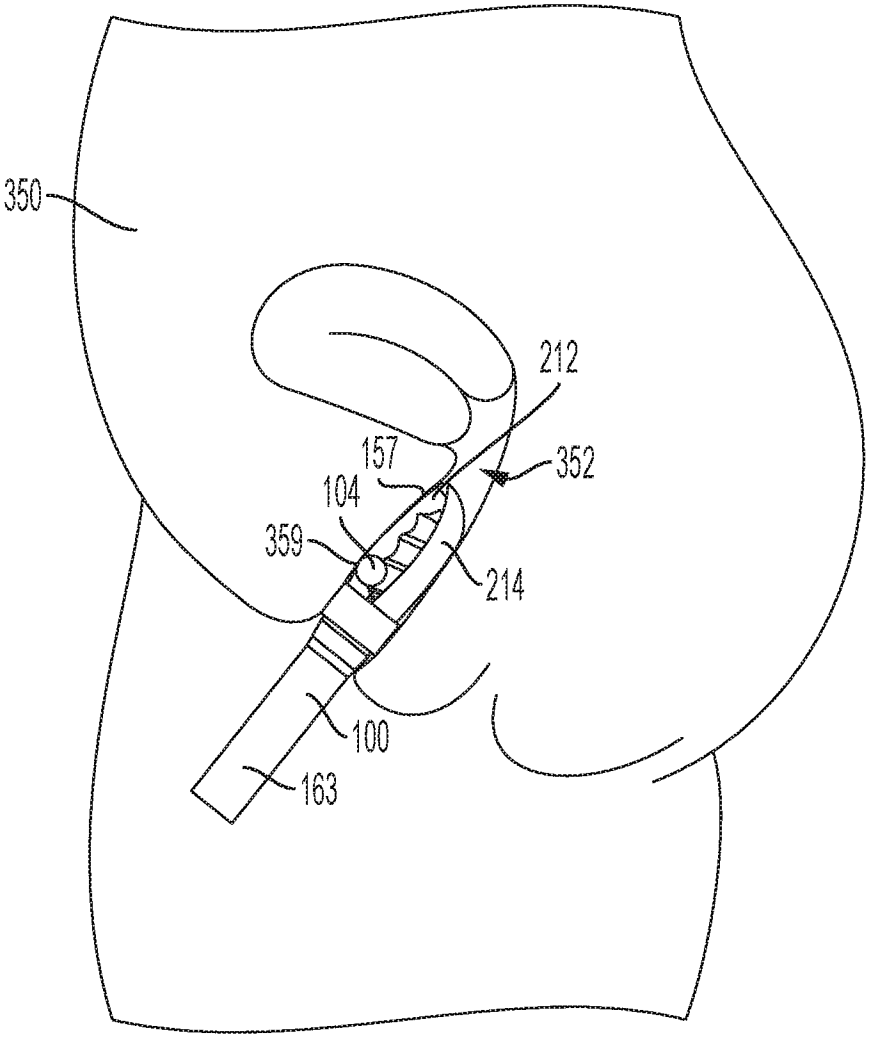
FIG. 7 shows an example usage of an embodiment of the present invention.

FIG. 7 shows an example usage of an embodiment 100 of the present invention. A user's body 350 is shown as a cross-section. User 350 has a massager device 700 in accordance with embodiments of the present invention inserted into the vagina 352. The device 100 is inserted into the vagina 352 such that the spherical roller 104 presses the sheath 157 against the G-spot region 359 of the user. Portion 212 is shown transparently. The user can manipulate the massager 100 inside the vagina 352 via handle 163.

Figure 8:
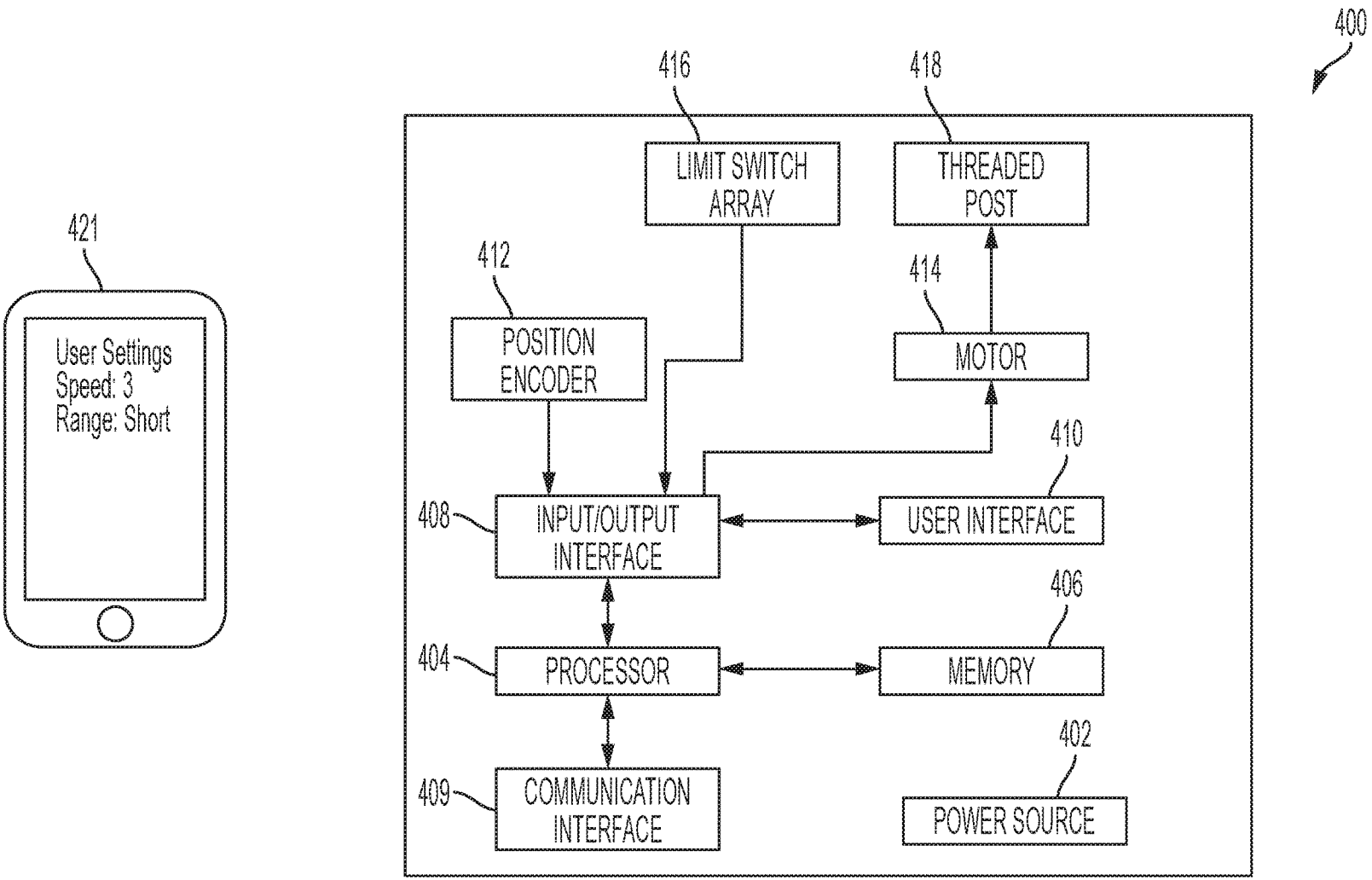
FIG. 8 is a block diagram showing components of an embodiment of the present invention.

FIG. 8 is a block diagram 400 showing components of an embodiment of the present invention. Diagram 400 includes a processor 404 and a memory 406 coupled to the processor 404, an input/output (I/O) interface 408 coupled to the processor 404, and a user interface 410 coupled to the I/O interface 408.

A power source 402 powers the processor 404, motor 414, and other electronic components. Power source 402 may be a battery, which may be a replaceable, or internally sealed rechargeable battery. In some embodiments, battery may be USB-chargeable, inductively chargeable, or other suitable charging mechanism now known or hereafter developed. It should be recognized that any power source, now known or hereafter developed, may be used. More than one battery may be included in some embodiments. In some embodiments, the stimulation device may be powered by alternating current power, such as 120V or 240V standard household power, with a power adapter comprising voltage regulators to convert the power to an appropriate DC level (e.g. 12V DC).

The memory 406 may include a computer readable medium including, but not limited to, flash, EEPROM, static ram (SRAM), or other suitable storage type. The memory 406 contains instructions, that when executed by processor 404, enable embodiments of the present invention. The memory 406 may be non-transitory. The user interface 410 may comprise one or more buttons, lights, buzzers, liquid crystal displays, and/or other suitable components for control and operation of the massager device.

The massager device may further include a communication interface 409, which may support a wired and/or wireless communication protocol, including, but not limited to, WiFi, Bluetooth, infrared, or other suitable communication protocol. The communication interface 409 can enable communication with a remote device 421 such as a smartphone or tablet computer to enable additional user interface functions on the remote device. In some embodiments, the massager device 400 may be controllable via an application on the remote device 421, instead of, or in addition to user interface 410. Thus, in some embodiments, the massager device is remotely controllable. Accordingly, in some embodiments, the user interface 410 may not be present.

The massager device further includes motor 414. The direction of movement of motor 414 may be controlled via a signal from input/output interface 408. The motor 414 is mechanically coupled to threaded post 418. A position encoder 412 may be used to allow the processor 404 to track the amount of rotation of the threaded post, and thus, the location of the spherical roller. Optionally, a limit switch array 416 may be utilized to detect an occurrence where the roller travels beyond a specified limit. The processor can be configured to disable the motor 414 under such a condition, for safety purposes. In other embodiments, the current level drawn by the motor is used as a criterion for position detection. In embodiments, the current level has a dramatic increase at the end of travel or if the ball stops. This condition can be used as a signal to stop operation of the device. This is an example condition, and other occurrences or conditions can be monitored and rectified if necessary.

Figure 9:
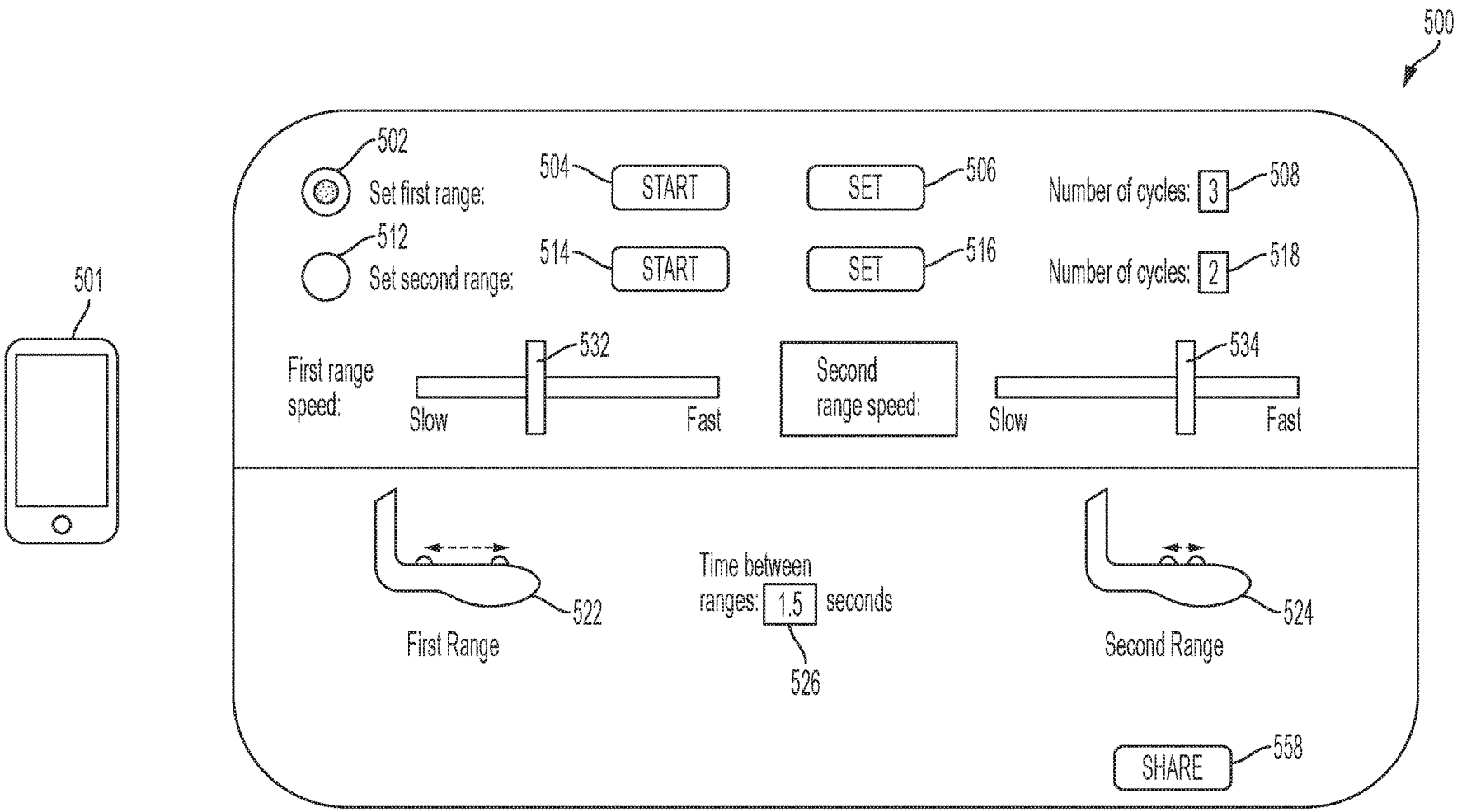
FIG. 9 is an exemplary user interface in accordance with embodiments of the present invention.

FIG. 9 is an exemplary user interface 500 in accordance with embodiments of the present invention. It should be recognized that user interface 500 is an example, and other configurations with more or fewer features thereon may be substituted within the scope of the invention. In embodiments, user interface 500 may be rendered on a remote controller (such as 421 of FIG. 8), such as the screen of a smartphone or tablet computer via an application ("app"), or other suitable electronic device. The electronic device may pair with the massager device via Bluetooth, WiFi or other wireless communication interface. Various operating parameters can be received from entry by a user on the user interface 500, and then sent to the massager device via wireless communication interface. The processor (404 of FIG. 8) can implement those operating parameters.

As shown on user interface 500, there is an option to set a first range (of motion). In this embodiment, the size of the range can be set by the user. The size of the range can be a distance that is a sub-range (a portion) of the full range. Multiple ranges may be supported in some embodiments. In the embodiment shown in FIG. 9, two ranges are supported. The first range has an associated start button 504 and a set button 506. To establish the first range, the user first selects the radio button 502 associated with the first range. The user then presses the start button 504. This starts the motor moving relatively slowly. When the roller 104 is in the desired start position, the user presses the set button 506. The roller 104 continues its motion. When the roller 104 is in the desired end position, the user presses the set button 506 again. The positional information (e.g. number of steps from the home position in a given direction) is then stored in memory 406. Memory 406 may include a non-volatile device such as battery-backed SRAM, flash, or other suitable storage. The user can then enter a number of cycles for that range in field 508. Similarly, to establish the second range, the user first selects the radio button 512 associated with the first range. The user then presses the start button 514. This starts the motor moving relatively slowly. When the roller 104 is in the desired start position, the user presses the set button 516. The roller 104 continues its motion. When the roller 104 is in the desired end position, the user presses the set button 516 again. The positional information is then stored in memory 406. The user can then enter a number of cycles for that range in field 518. The user can adjust the motor speed for the first range with slider control 532. Similarly, the user can adjust the motor speed for the second range with slider control 534. It should be recognized that this is an example user interface, and that other configurations are included within the scope of the invention. More, fewer, or different features may be included. In addition, the shown buttons, sliders, fields, and other input devices are examples, and other suitable inputs devices may be substituted within the scope of the invention.

Embodiments may further include a graphic indication of the range settings. Graphic indication 522 shows an indication of the range of motion of the roller for the first range. Similarly, graphic indication 524 shows an indication of the range of motion of the roller for the second range. Additionally, in embodiments, a time between ranges (range transition time) may be specified in field 526. Thus, with the exemplary data shown in user interface 500, the massager device moves the spherical roller back and forth within the first range of motion three times. The spherical roller then moves to the start of the second range, taking 1.5 seconds to do so. The massager device moves the roller back and forth within the second range of motion two times. The cycle then repeats. In embodiments, the processor converts the time specified in field 526 to a number of steps.

Thus, in embodiments, the memory (e.g., 406 of FIG. 8) contains instructions, that when executed by the processor, alternate motion direction of the motor such that the spherical roller oscillates between the start range position and the end range position. In some embodiments, the memory contains instructions, that when executed by the processor, establish a second start range position and a second end range position, wherein the second start range position and second end range position define a second range. In some embodiments, the memory contains instructions, that when executed by the processor, establish a range transition time to switch between the first range and the second range.

In some embodiments, the operation parameters entered into user interface 500 can be stored in the memory (e.g., 406 of FIG. 4) as part of a user profile. In some embodiments, multiple profiles may be stored. A user profile defines, and may render, the ranges, speeds, and range transition time associated with a user name and/or user device (e.g. smartphone). In some embodiments, a profile may be shared with other users, for example, by clicking the share button 558. In embodiments, the sharing may be performed using the application that provides the user interface. As an example, a first user may establish a profile that specifies a first range, second range, corresponding cycle counts, and range transition time for operation of the massager device. The user can then send that profile data to second user (e.g., to their mobile electronic device). The second user can then control a massager device of embodiments (of his/her own) using the first user's profile information. In this way, the ability to share profiles with other users enables a social aspect of usage of the massager device. It should be recognized that user interface and 900, and its functions, may be implemented with devices for massage other than the embodiments disclosed herein within the scope of the invention.

Figure 10B:
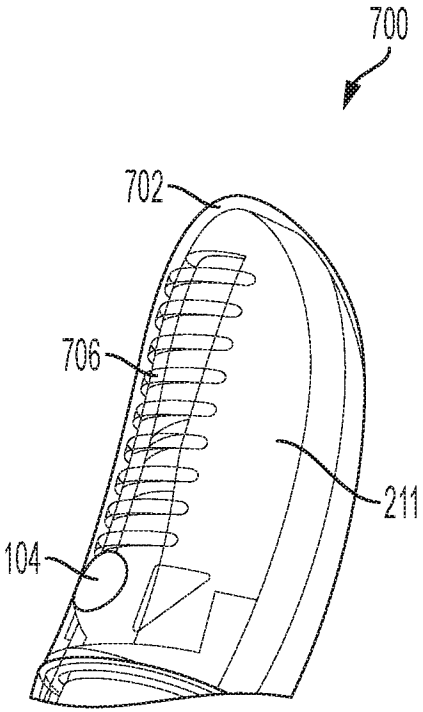
FIG. 10B shows the massage surface with the enclosure inserted therein.
Figure 10A:
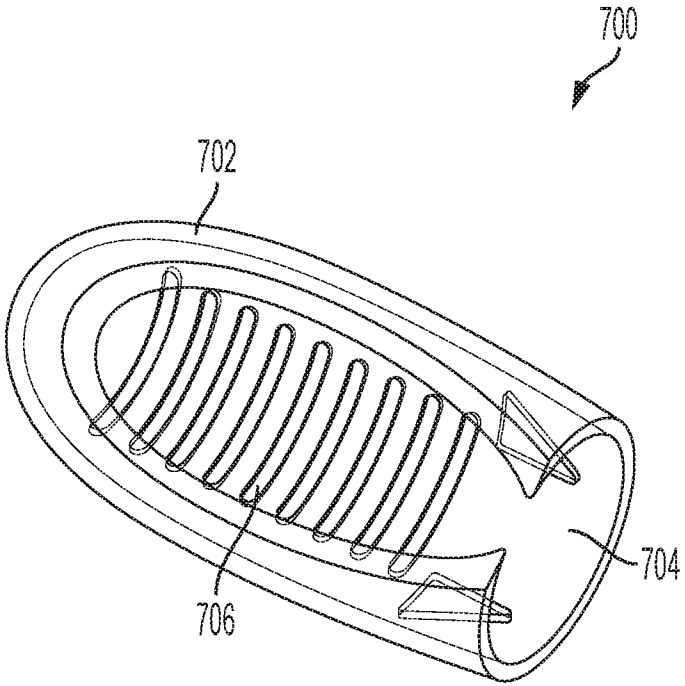
FIG. 10A shows an example massage surface without an enclosure therein.

FIGS. 10A and 10B show a massage surface 700 in accordance with embodiments of the present invention. The massage surface 700 may be formed as a sleeve/sheath of a non-permeable material such as silicone, having an opening 704 for receiving an enclosure (e.g., 211 of FIG. 2A). FIG. 10A shows the massage surface without the enclosure. FIG. 10B shows the massage surface with the enclosure 211 inserted into the opening 704 and the roller 104 pushing the membrane 702 outward. In embodiments, the massage surface may include a plurality of grooves formed into the membrane 702. Other shapes may be formed on the massage surface 700, including, but not limited to, bumps, spikes, diagonal lines, and/or other suitable shapes and patterns to provide for additional stimulation and pleasurable sensations.

Figure 11D:
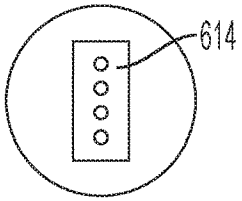
FIG. 11D shows a bottom surface of the anal plug of FIG. 11A.
Figure 11C:
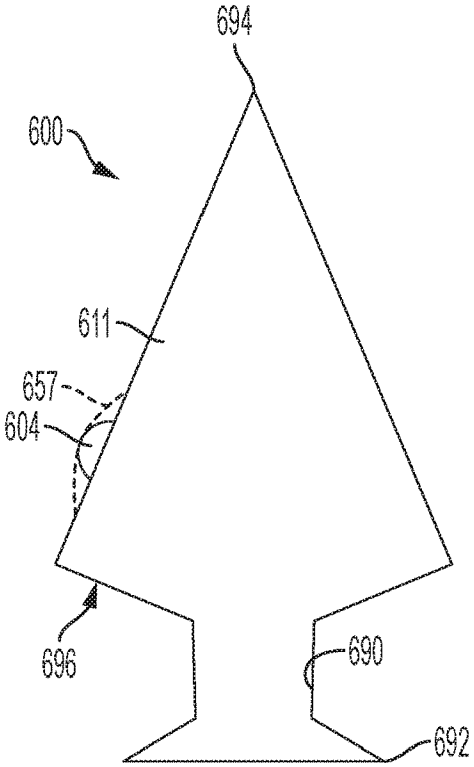
FIG. 11C shows a side view of the anal plug of FIG. 11A.
Figure 11B:
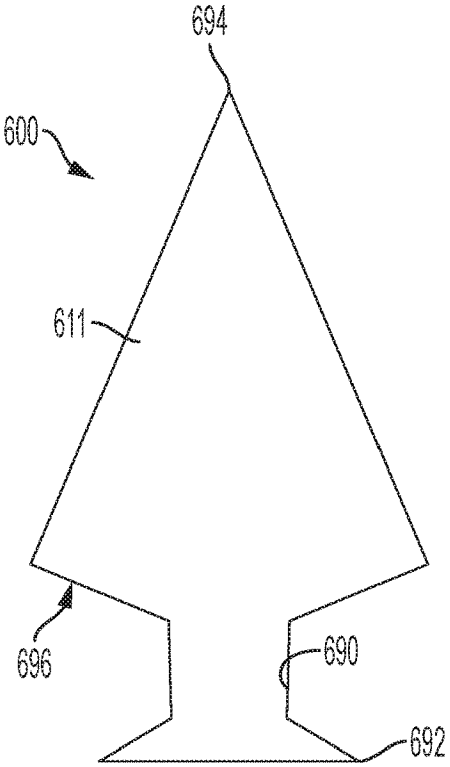
FIG. 11B shows a back view of the anal plug of FIG. 11A.
Figure 11A:
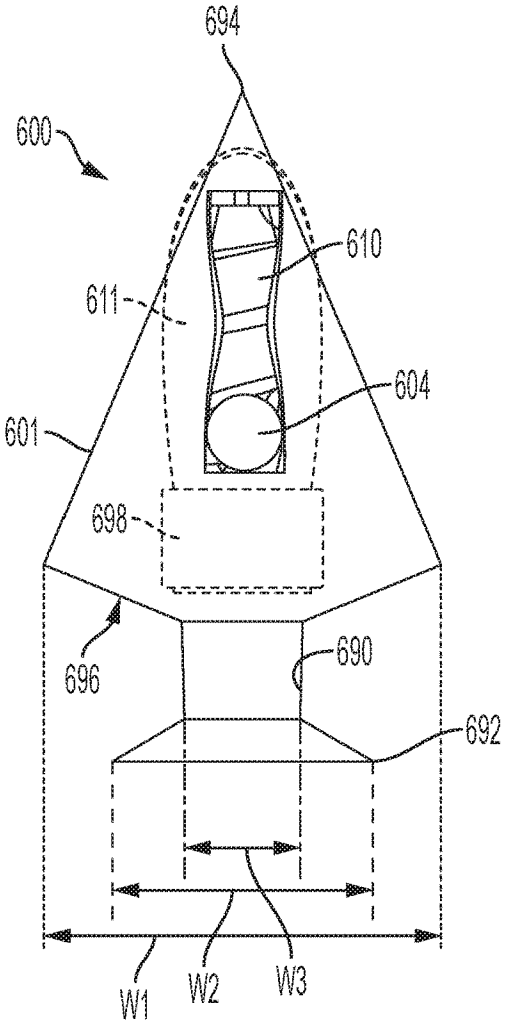
FIG. 11A shows a front view of an anal plug in accordance with some embodiments of the invention, without the massage surface sheath disposed thereon for clarity.

FIGS. 11A-11D show an alternative embodiment of the invention. In some embodiments, the stimulator is a prostate massager configured similarly to the other embodiments disclosed herein, except there is a housing 601, integral with or disposed around the enclosure 611, which defines an anal plug. In some embodiments, the massager is an anal plug 600 configured for insertion into an anus of a user. FIG. 11A shows a front view of the anal plug 600 without the massage surface sheath disposed thereon for clarity. FIG. 11B shows a back view of anal plug 600. FIG. 11C shows a side view of anal plug 600 (the opposite side looks symmetrical to the side shown). FIG. 11D shows a bottom surface (handle) of anal plug 600. The enclosure 611 is substantially cone-shaped with a tip 694 and a side 696 opposite the tip 694 that is wider than the tip. A threaded post 610 and roller 604 are included, with internal components such as motor and battery represented generally at 698. A flexible membrane massage surface like 157 of FIG. 1 is disposed over the opening through which roller 104 protrudes. Side 696 has a width W1. A first side of a neck 690 is affixed to side 696. A second side of the neck 690 is affixed to a base 692, which is wider than the neck 690. Neck 690 has a width W2, and base 692 has a width W3. In some embodiments, W1 is between 1 cm and 6 cm. In some embodiments, W2 is between 0.5 cm and 3 cm. In some embodiments, W3 is between 2 cm and 4 cm. These values are examples, and other suitable values are included within the scope of the present invention.

Roller 604 of anal plug 600 is substantially similar to roller 104 and threaded post 610 is substantially similar to threaded post 210. The other components disclosed herein with respect to FIGS. 1-9 are included within the scope of this embodiment. The conical enclosure is disposed for insertion into an anus of the user. During use, the neck sits within the anus of the user while the conical enclosure is within the rectum. The flared based prevents the anal plug 600 from going completely into the rectum, such that the user can remove it safely. User interface 614 is similar to user interface 134 of FIG. 1C.

Figure 12B:
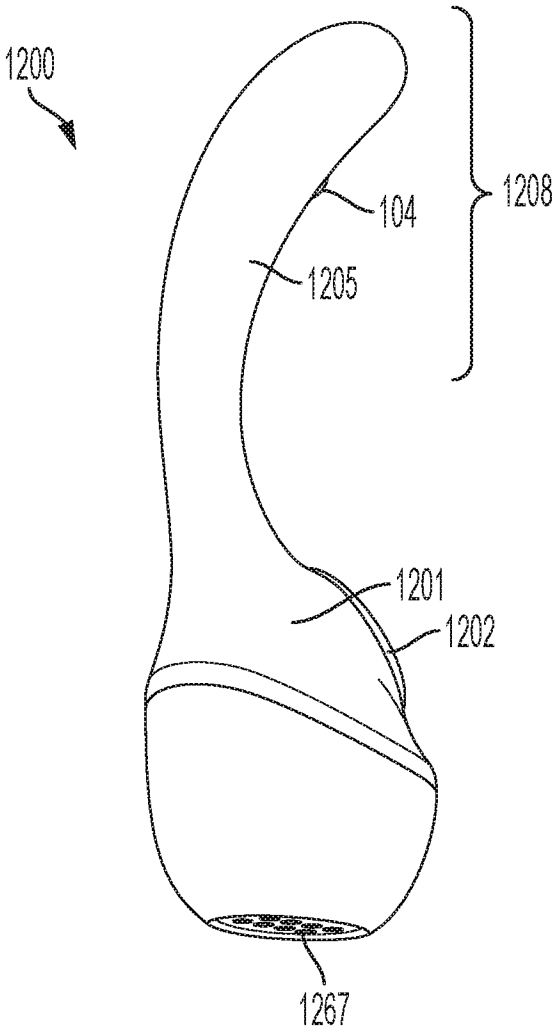
FIG. 12B shows a rear perspective view of a massager device in accordance with some embodiments of the invention.
Figure 12A:
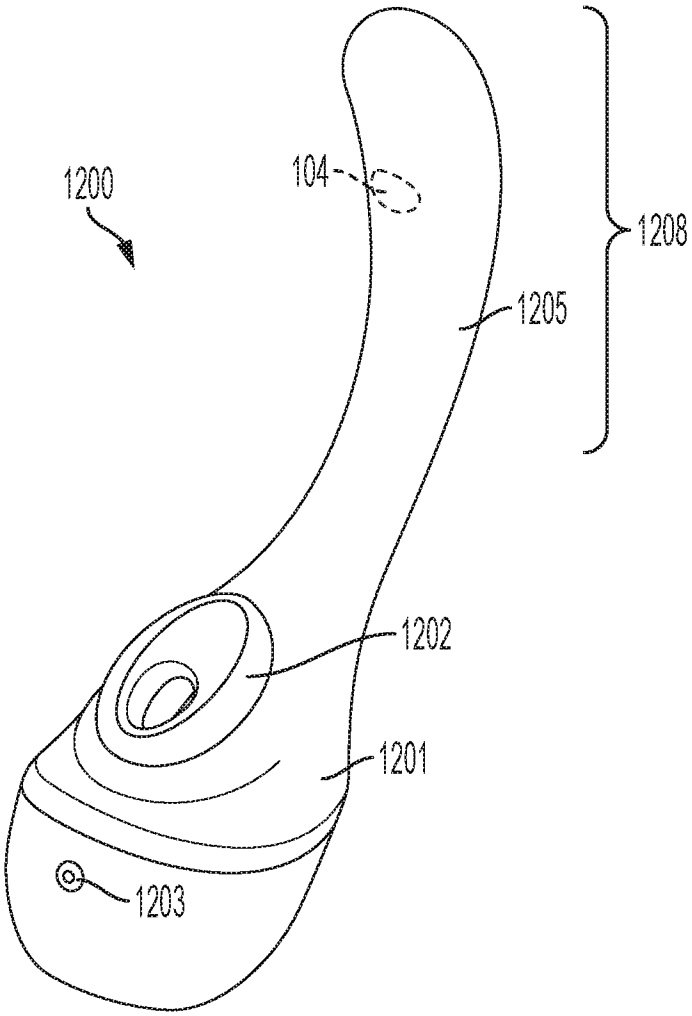
FIG. 12A shows a front perspective view of a massager device in accordance with some embodiments of the invention.
Figure 13:
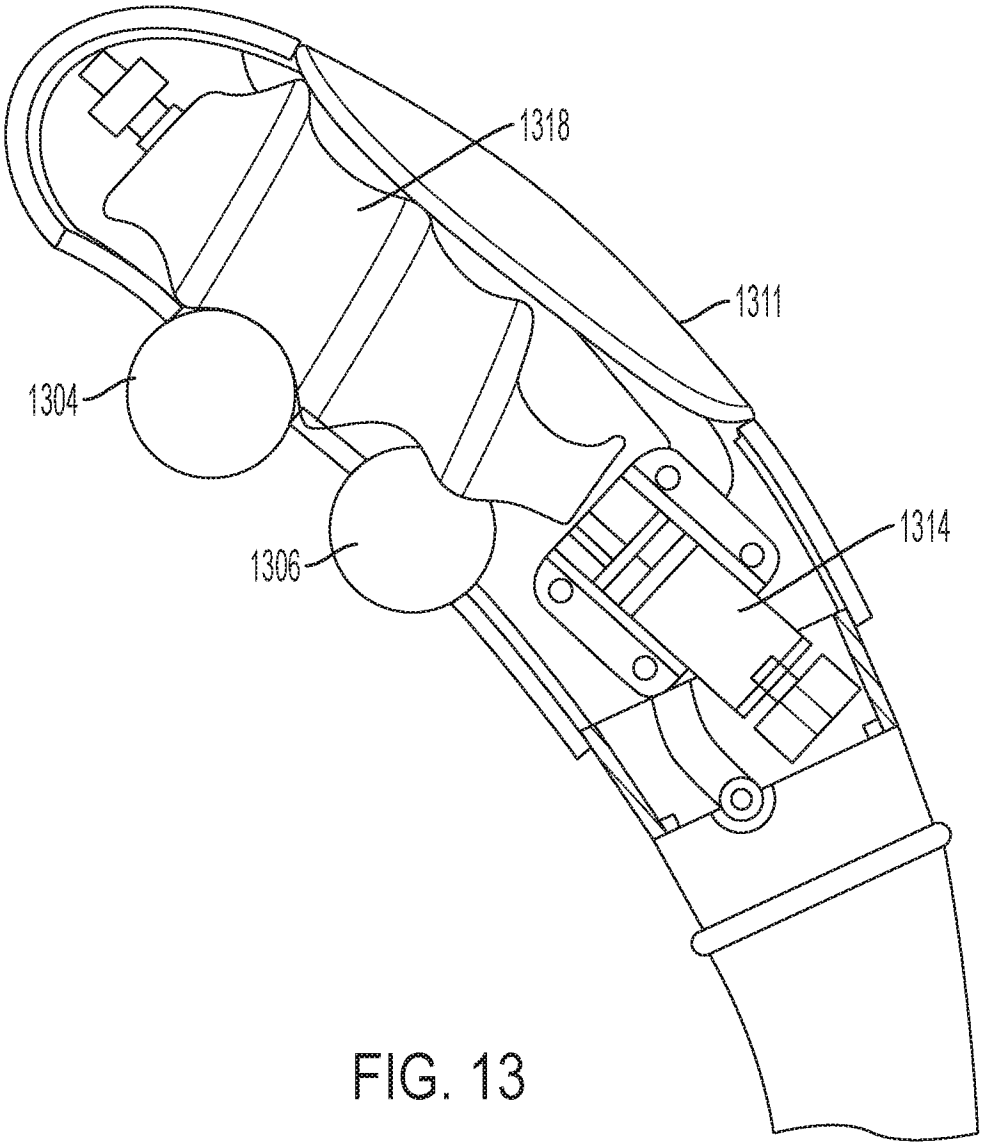
FIG. 13 shows a portion of an alternative embodiment of the present invention with multiple rollers disposed on a threaded post.

FIG. 12A shows a front perspective view of a massager device 1200 in accordance with embodiments of the invention. FIG. 12B shows a back perspective view of a massager device 1200 in accordance with embodiments of the invention. In some embodiments, the enclosure covered by a sheath 1205 forms an insertable shaft 1208. Roller 104 is shown protruding under elastic sheath 1205. Internal components are under the sheath and not shown, but are similar to those in device 100. In some embodiments, the device includes a second stimulator. In some embodiments, the shaft is insertable into a vagina of a user while a second stimulator 1201 may provide stimulation to a user's clitoris. In some embodiments, the second stimulator is a pressure field stimulator having a cup 1202 which is varied in volume by a driver to create a pressure field when placed over a user's skin. In some embodiments, instead of a pressure field stimulator, the second stimulator 1201 may be a vibrator, gyrator, pulsator, or other device. A charging port 1203 and user interface 1267 are in view. FIG. 13 shows a cutaway view of a portion of an alternative embodiment of the present invention including a plurality of rollers, with the external sheath removed for clarity. In this embodiment, a first roller 1304 and a second roller 1306 are included within enclosure 1311. As the motor 1314 turns the threaded post 1318, both rollers 1304 and 1306 are moved back and forth, creating a unique sensation in the G-spot area of a user. Thus, in some embodiments, a plurality of rollers are included. As shown, there are two rollers on a single threaded post 1318 in the example. In some embodiments, there may be more than two rollers included. In some embodiments, the first roller 1304 and second roller 1306 may be of the same size and/or shape. In other embodiments, the first roller 1304 may be of a different size and/or shape than the second roller 1306.

Figure 14:
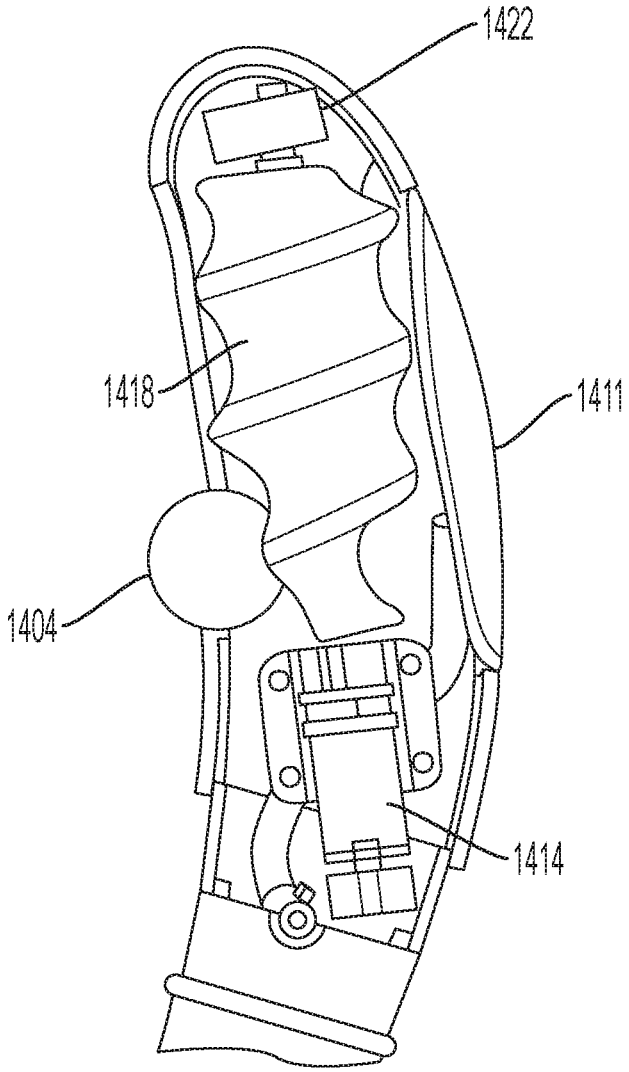
FIG. 14 shows an embodiment, wherein a vibrator is included within the shaft/enclosure along with the roller massager.

FIG. 14 shows a cutaway view of an embodiment, wherein a vibrator 1422 (such as a pancake motor) in included within the shaft/enclosure along with the roller massager. Vibration stimulation can be imparted as well as massage of the roller. In embodiments, the enclosure 1411 includes a first motor 1414 which is coupled to threaded post 1418. Roller 1404 is disposed on threaded post 1418. As the first motor 1414 rotates the threaded post 1418, the roller moves along the threaded post 1418, creating a massaging sensation for the user. A second motor 1422 may be included within enclosure 1411 for imparting vibration to the enclosure 1411. The vibration can provide an additional pleasurable sensation for the user. In embodiments, the second motor may be a pancake motor. In embodiments, the second motor may be disposed at a distal end of the threaded post 1418, opposite the first motor 1414. In embodiments, the second motor 1422 may be configured to operate independently of the first motor 1414, such that the user can enable or disable the vibration independently of the operation of the roller 1404.

Figure 15:
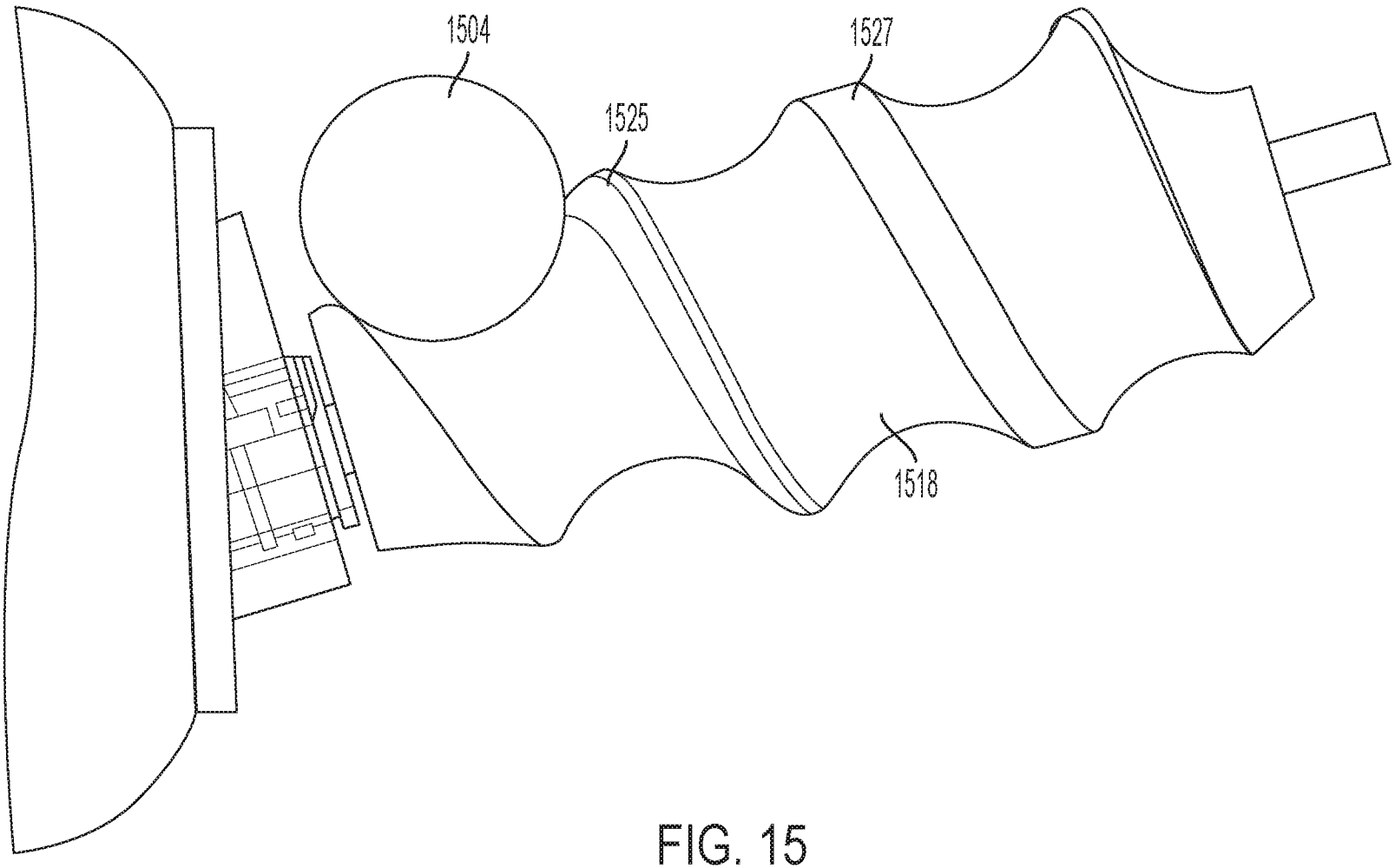
FIG. 15 shows an embodiment where threaded post has flattened portions of the threads.

FIG. 15 shows an embodiment where threaded post 1518 has one or more flattened portions 1527 of the threads such that the friction of the elastic sheath (e.g. 157 of FIG. 1A) causes the roller 1504 to travel over those portions rather than smoothly follow the threads of the threaded post 1518. This creates a "bump" sensation that can be pleasurable to a user. The threaded post 1518 may also include some non-flattened portion(s) 1525 of threads. Accordingly, in some embodiments the threads of the threaded post are of an irregular shape. In some embodiments, the threaded post 1518 includes one or more flattened portions of threads. In some embodiments, the threaded post 1518 may include a combination of flattened and non-flattened portions of threads.

Figure 16B:
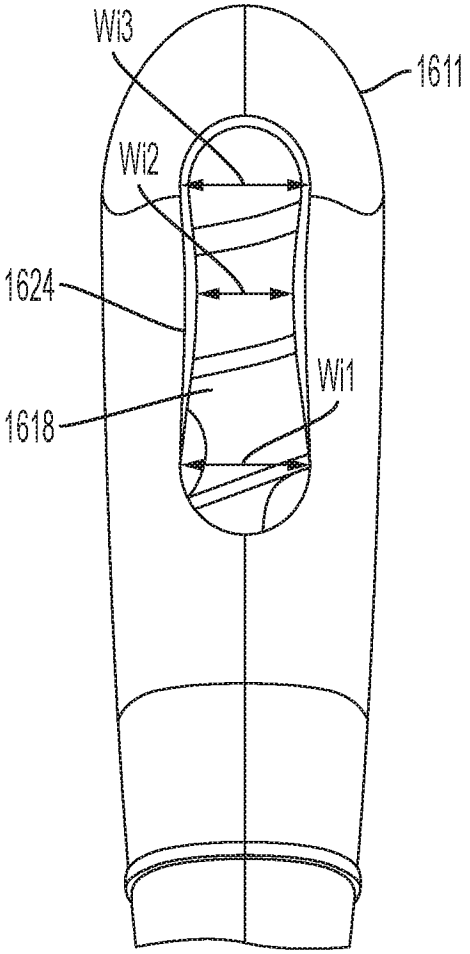
FIG. 16B shows a diagram of how portions of the opening of the enclosure may be narrower in some areas than in others to achieve a desired plane of the roller protruding therefrom.
Figure 16A:
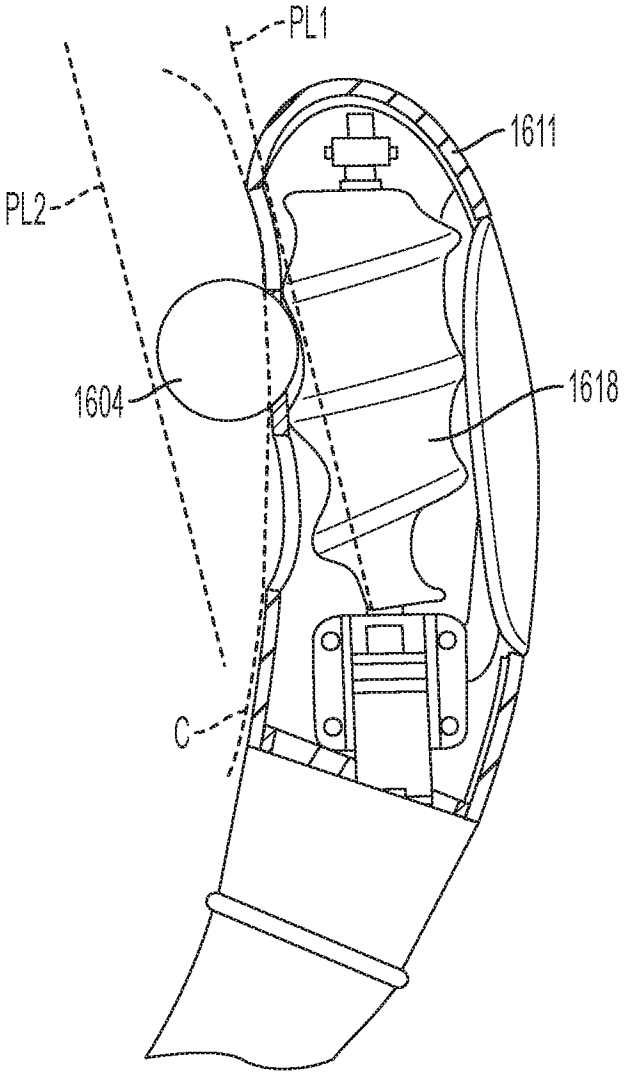
FIG. 16A shows a diagram of planes of the second stimulator of some embodiments of the present invention.

FIG. 16A and FIG. 16B show diagrams of how portions of the opening of the enclosure may be narrower in some areas than in others to achieve a desired plane of the roller protruding therefrom. Referring now to FIG. 16A, showing a side cutaway view of a shaft portion. The threaded post 1618 is disposed such that it has a plane PL1 parallel to its longitudinal axis. The enclosure 1611 is formed with a curvature C such that the protrusion of the roller 1604 is such that the travel of the roller 1604 is along a plane PL2, where plane PL2 is parallel to plane PL1. FIG. 16B shows the opening 1624 having a varying width. As shown in FIG. 16B, there is a first width Wi1, a second width Wi2, and third width Wi3. In some embodiments, width Wi2 is less than width Wi1, and width Wi2 is less than width Wi3. The width of the opening 1624 controls the amount of protrusion of the roller 1604. The width of the opening 1624 can be selected to control the amount of protrusion, and thus, affect the travel path of roller 1604.

Figure 17:
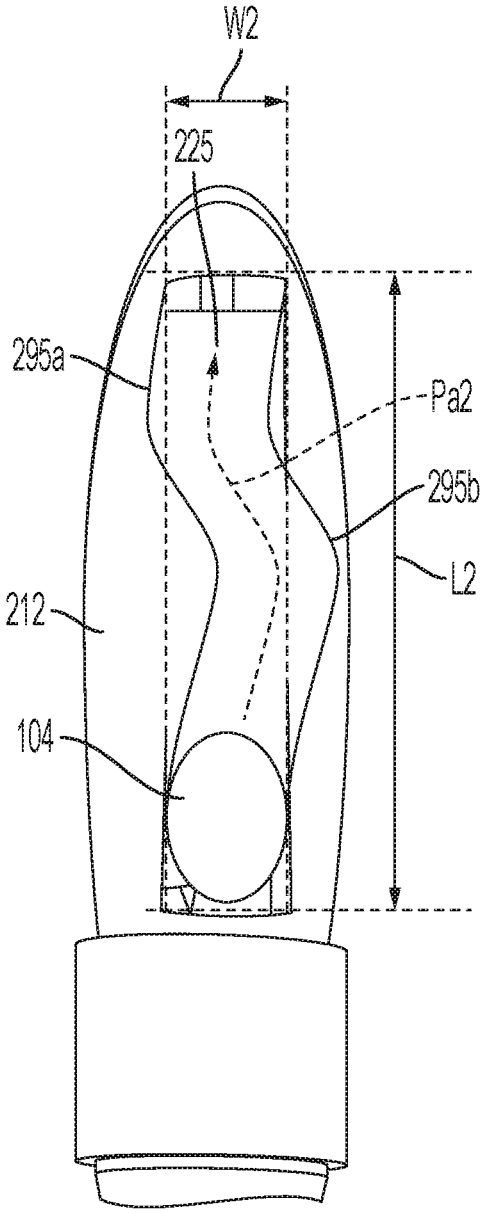
FIG. 17 is a front view of a portion of a massager device in accordance with alternative embodiments of the present invention.

FIG. 17 is a front view of a portion of a massager device in accordance with alternative embodiments of the present invention showing detail of the enclosure portion 212 without a sheath thereon. The embodiment of FIG. 17 comprises an opening 225 which comprises non-linear rails 295*a* and 295*b*. The non-linear rails cause the roller 104 to move along path P2 when the threaded post rotates. Thus, in embodiments, the massager device is configured such that the travel path of the roller is non-linear. In some embodiments, as shown in FIG. 17, the path Pa2 of roller 104 is an S-curve. Thus, in embodiments, the roller travels in an S-curve path between the start range position and the end range position. Other non-linear paths are possible with embodiments of the present invention. The non-linear path of the roller 104 can create a pleasurable sensation in some users, as compared with a linear path as depicted in FIG. 2C.

Figure 18A:
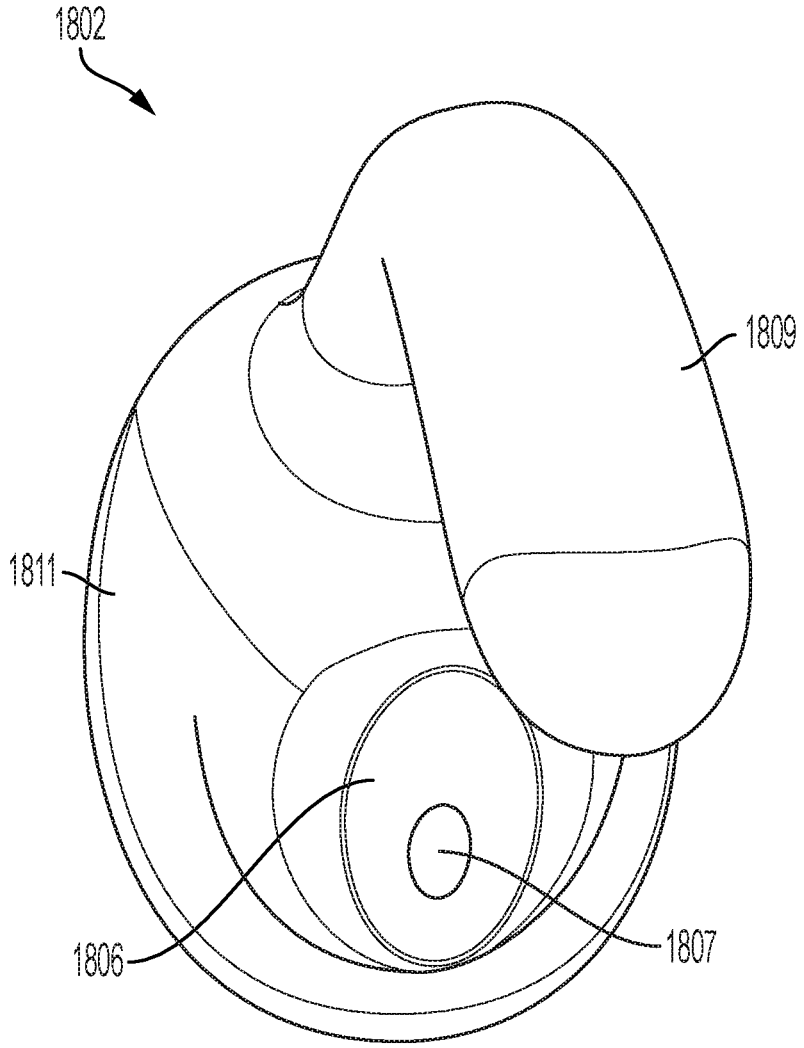
FIG. 18A shows a top-down view of a sheath that is disposed over the device.
Figure 18B:
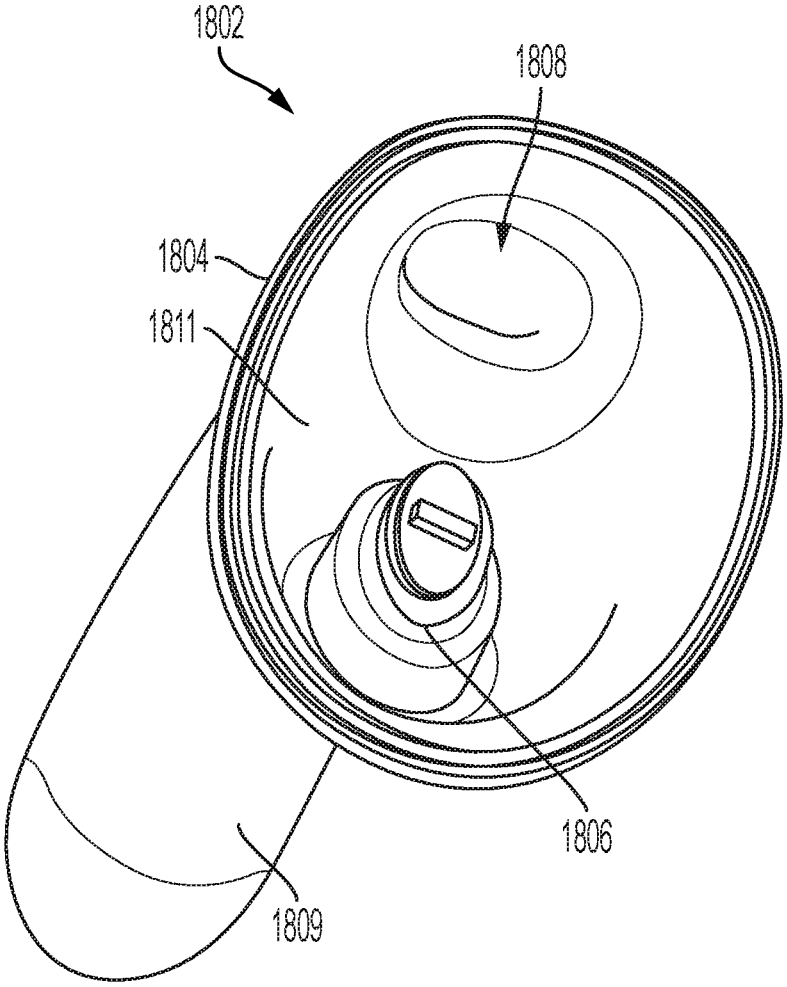
FIG. 18B shows a bottom-up view of a sheath that is disposed over the device.

FIGS. 18A and 18B show views of a sheath that is disposed over the enclosure/shaft, as well as pressure field stimulator (having a cup 1806) and/or vibrator, if present. FIG. 18A shows a top-down view. The sheath 1802 is flexible, resilient, and elastic, and includes a shaft portion 1809 that stretches over the shaft and an integrated base portion 1811 that attaches to the enclosure and/or housing of the base/second stimulator of embodiments with a tight fit. In some embodiments, the sheath is made of silicone, rubber, TPE, plastic or other flexible and elastic material. "Elastic material" herein is a material that is expandable by force (such as roller), but returns to its original size when the force (e.g., of the roller) is removed. The cup 1806 includes cavity 1807. The cup 1806, in some embodiments, is molded into the sheath. In such embodiments, the cup and sheath may be injection molded via a single mold such that the resulting cup-sheath is a single piece and not made of two pieces. In some embodiments, the cup is not present. Thus, in embodiments, the covering of the shaft, base, and the cup can be formed as an integrated piece of elastic material.

Referring to FIG. 18B, a bottom-up view of sheath 1802 is shown, illustrating the interior of the sheath. During assembly of disclosed embodiments, an interior shaft opening 1808 is configured and disposed to receive an enclosure comprising one or more rollers and a threaded post. An attachment point 1804 is formed around the base portion 1811. In embodiments, attachment point 1804 comprises a raised lip (protrusion) of material. The sheath is attached to the shaft or housing in any suitable way. In some embodiments, it may be via reciprocal grooves and protrusions on the shaft or base housing, and sheath, noted as attachment point on the sheath. The sheath may be adhered to the shaft/housing instead or in addition to reciprocal grooves and protrusions.

Figure 19:
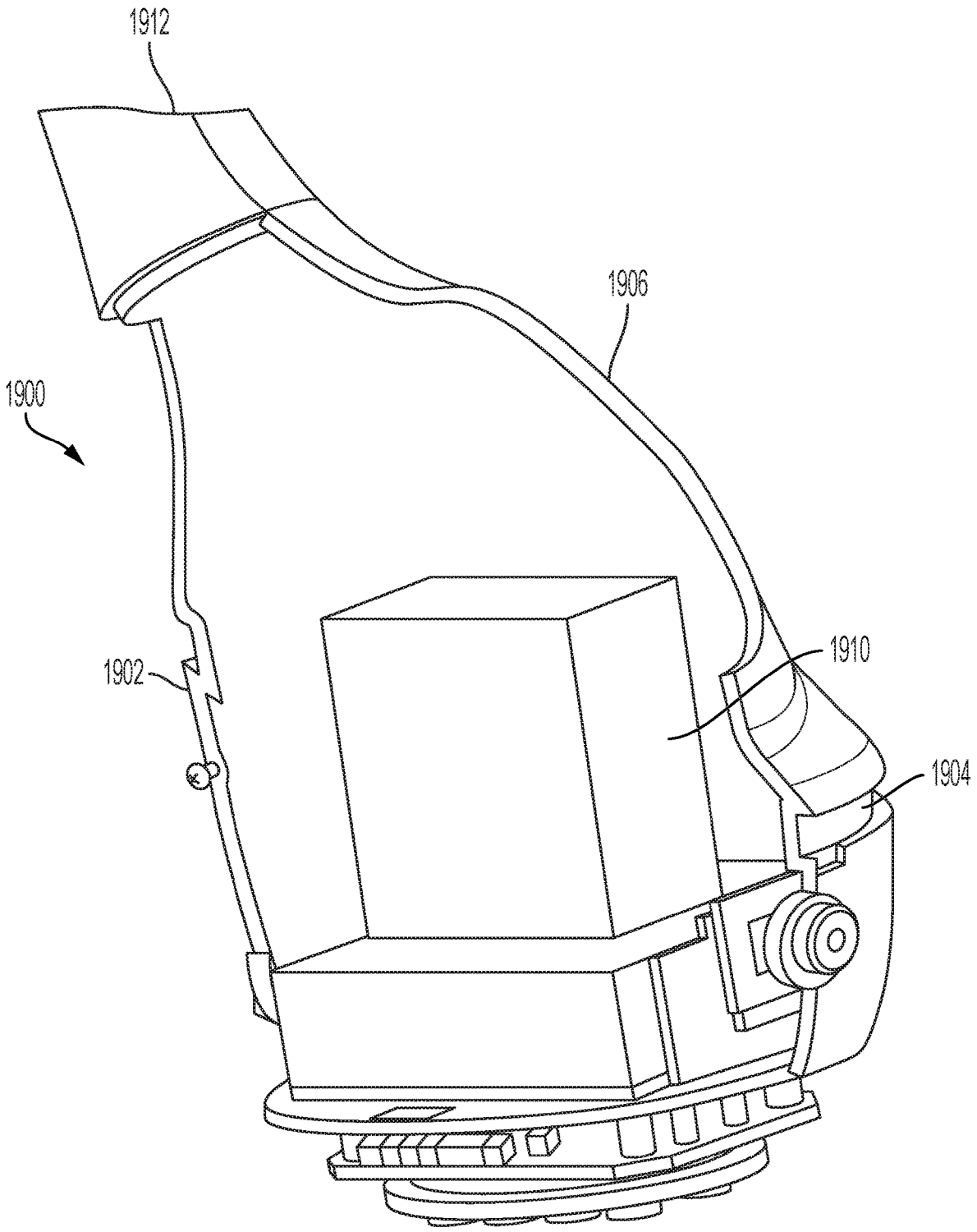
FIG. 19 shows a representation of the internal components of a base including a pressure field stimulator in accordance with some embodiments of the invention.

FIG. 19 shows a partial view of the internal components of a base including a second stimulator 1900 in accordance with some embodiments of the invention. A portion of the housing, and where the sheath attaches, extending from shaft 1912 is in view. The second stimulator 1900 includes a housing 1902 that houses internal components, including, but not limited to, motor(s), pump(s), batteries, circuits, and/or other components represented generally at 1910. When the second stimulator is a pressure field stimulator, 1910 includes an apparatus to vary a volume of the cup. An attachment point, such as groove 1904, is formed within the housing 1902 that is configured and disposed to receive attachment point 1804 (FIG. 16B) of the sheath 1802. The housing 1902 may further include at least one support flange 1906, which provides mechanical support for the base portion 1811 and/or cup 1806 of the sheath 1802. In some embodiments, the width of the groove 1904 and the width of protrusion 1804 are sized such that a tight friction fit forms between them when the protrusion 1804 is applied to groove 1904. In some embodiments, the sheath 1802 may be removable by the user to facilitate cleaning. In other embodiments, the sheath 1802 may be permanently affixed to the housing 1902 via adhesive, sealant, or other suitable technique.

Figure 20A:
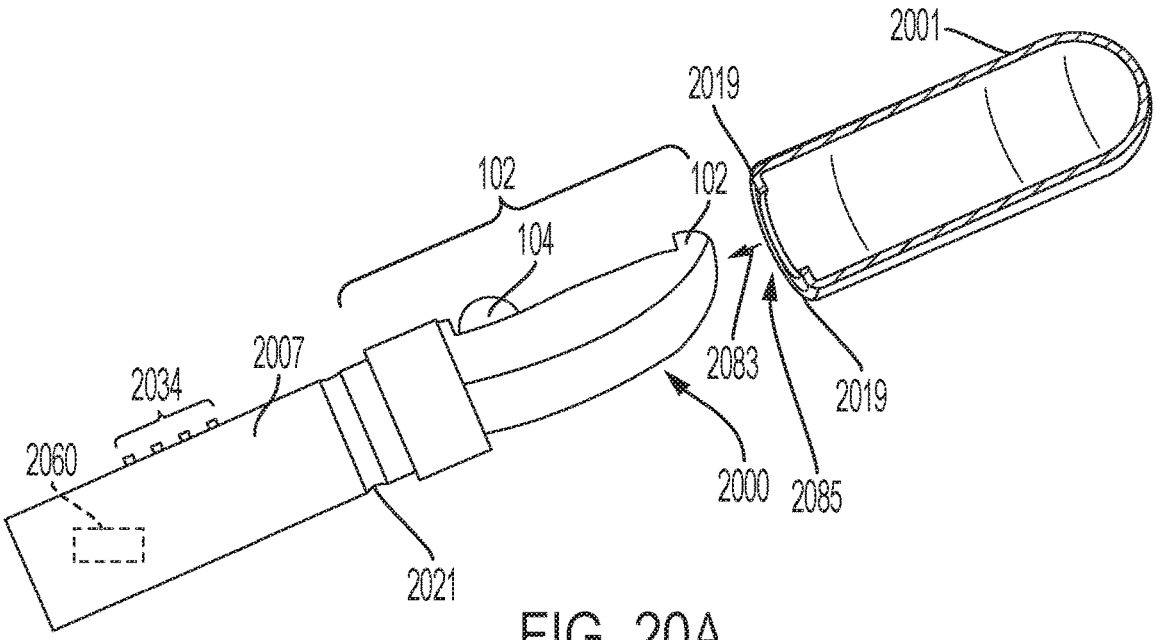
FIG. 20A shows a side view of a device in accordance with some embodiments having an insertable shaft portion, and a detached sheath shown in cross-section view for clarity.

FIG. 20A shows a side view of a device 2000 having insertable shaft portion 102, and a detached sheath 2001 shown in cross-section view for clarity, in accordance with some embodiments of the present invention. Device 200 include a handle 2007. In some embodiments, some components for massage stimulator are housed in the handle 2007 (such as a battery, for example). Such components may be disposed within a hollow cavity or embedded in the substantially rigid material of the handle. These components are shown generally as 2060. Handle 2007 may be made of plastic, glass, wood, TPE, silicone, or other suitable material. Protrusion 2019 extends around the entire cross-section of the sheath 2001. When sheath 2001 is pulled down in direction 2083 over insertable shaft 102 (such that insertable shaft 102 fits up through sheath opening 2085), protrusion 2019 interlocks with groove 2021 on device 2000. The reciprocal groove 2021 and protrusion 2019 may be of a size and configuration that they may hold together by friction fit.

In other embodiments, adhesive may be used instead of or in addition to the reciprocal groove and protrusion.

Figure 20B:
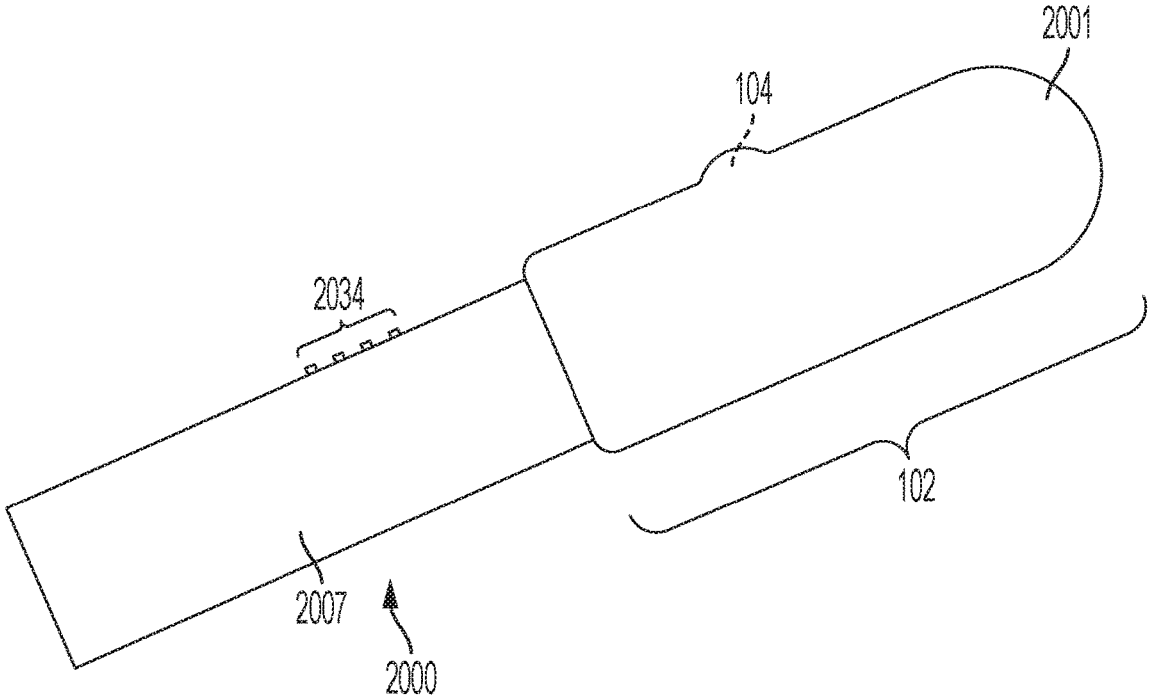
FIG. 20B shows a side view of a device in accordance with some embodiments having a sheath thereon.
Figure 20C:
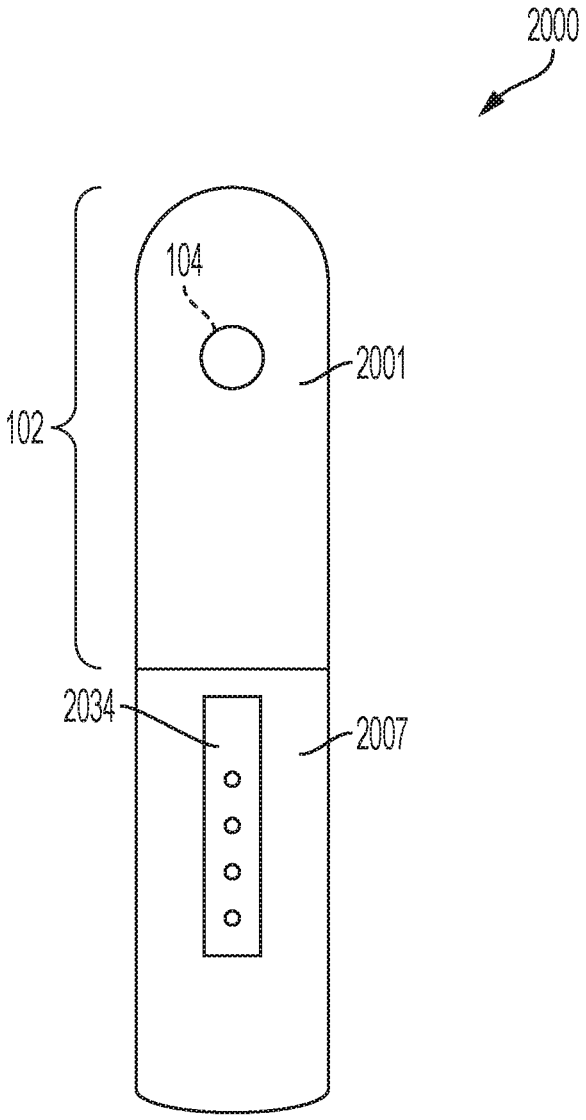
FIG. 20C shows a front view of a device in accordance with some embodiments having sheath thereon.

FIG. 20B shows a side view of a device 2000, and FIG. 7C shows a front view of a device 2000, each having sheath 2001 thereon. Exterior sheath 2001 is shown thereon with roller 104 protruding. A user interface 2034 is also shown. In some embodiments, user interface 734 comprises at least one button or other input device to power on and allow a user to scan through settings of the speed (of the roller) or other parameter of the stimulator. In some embodiments, in addition to or instead of, the onboard user interface 734, the massager is remotely controlled by a dedicated remote-control device, or an application run on a smartphone, tablet or computer.

Some embodiments are unitary in structure, meaning the components thereof together form a single product, rather than multiple products which may be used together by a user.

Some embodiments are waterproof such that they may be washed with fluids, like soap and water. Accordingly, the sheath and any other external portions are sealed. This allows a user to clean the device thoroughly between insertions.

It should be recognized that although described as applicable to massage of a G-spot, prostate, or clitoris, that embodiments may be used for stimulation of any suitable body part.

As can now be appreciated, disclosed embodiments provide improvements in G-spot and prostate massaging devices by utilizing a roller disposed within a plurality of pitched threads of a motorized threaded post, enabling precise control of the motion of the spherical roller to provide a new level of G-spot and prostate stimulation.

While the invention has been particularly shown and described in conjunction with exemplary embodiments, it will be appreciated that variations and modifications will occur to those skilled in the art.

The embodiments according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A massager device, comprising:

an enclosure comprising an opening, wherein the enclosure is an elongate shape;

a threaded post disposed within the enclosure, the threaded post comprising a plurality of pitched threads;

a guide defining the opening in the enclosure, the guide having a first rail and a second rail;

a spherical object disposed within the plurality of pitched threads, wherein the spherical object protrudes outside the opening of the enclosure between the first rail and the second rail;

a driver configured to rotate the threaded post; and an elastic sheath disposed at least over the opening.

2. The massager device of claim 1, wherein the elastic sheath further covers the enclosure.

3. The massager device of claim 1, wherein the opening is disposed along a longitudinal axis of the elongate shape.

4. The massager device of claim 1, configured for insertion into a vagina of a user.

5. The massager device of claim 1, configured for insertion into an anus of a user.

6. The massager device of claim 1, wherein the spherical object is a G-spot stimulator or a prostate stimulator.

7. The massager device of claim 1, further comprising a handle.

8. The massager device of claim 1, further comprising an onboard user interface.

9. The massager device of claim 1 wherein there is a second spherical object disposed on the threaded post.

10. The massager device of claim 1, further comprising a vibrator mechanically coupled to the threaded post.

11. The massager device of claim 1, wherein the threaded post is tapered.

12. The massager device of claim 1, wherein the opening has a varied width.

13. The massager device of claim 1, wherein the enclosure is formed with a curvature such that a path of the spherical object is along a plane parallel to a longitudinal axis of the threaded post.

14. A massager device, comprising:

an enclosure comprising an opening, wherein the enclosure is an elongate shape;

a threaded post disposed within the enclosure, the threaded post comprising a plurality of pitched threads;

a guide defining the opening in the enclosure, the guide having a first rail and a second rail;

a spherical object disposed within the plurality of pitched threads, where the spherical object protrudes through the opening of the enclosure between the first rail and the second rail;

a motor, the motor mechanically coupled to the threaded post;

an elastic sheath disposed at least over the opening and covering the spherical object;

a processor; and a memory coupled to the processor, wherein the memory contains instructions, that when executed by the processor, alternate motion direction of the motor such that the spherical object oscillates on a path between a start range position and an end range position.

15. The massager device of claim 14, wherein the memory further contains instructions, that when executed by the processor, receive the start range position for the path of the spherical object as user input.

16. The massager device of claim 14, wherein the memory further contains instructions, that when executed by the processor, receive the end range position for the path of the spherical object as user input.

17. The massager device of claim 14, wherein the start range position and the end range position define a first range;

wherein the memory contains instructions, that when executed by the processor, establish a second start range position and a second end range position, wherein the second start range position and second end range position define a second range.

18. The massager device of claim 17, wherein the memory contains instructions, that when executed by the processor, establish a range transition time to switch between the first range and the second range.

19. The massager device of claim 14, wherein the path is linear.

20. The massager device of claim 14, wherein the path is non-linear.

21. The massager device of claim 14, wherein the path is an S-curve.

22. The massager device of claim 17, wherein the memory further contains instructions, that when executed by the processor, alternate motion direction of the motor such that the spherical object oscillates on a path between the second start range position and second end range position.

23. The massager device of claim 22, wherein the memory contains instructions, that when executed by the processor, establish a range transition time to switch between the first range and the second range.

24. The massager device of claim 14 wherein the enclosure is formed with a curvature such that travel of the spherical object is along a plane parallel to a longitudinal axis of the threaded post.

25. The massager device of claim 14, wherein the threaded post comprises one or more flattened portions of threads, and one or more non-flattened portions of threads.

26. The massager device of claim 14, wherein the spherical object is a prostate stimulator.

27. The massager device of claim 14, wherein the motor is remotely controllable.

* * * * *